US010073365B2

(12) United States Patent
Ueda et al.

(10) Patent No.: US 10,073,365 B2
(45) Date of Patent: Sep. 11, 2018

(54) ELECTROPHOTOGRAPHIC PHOTORECEPTOR, METHOD OF PRODUCING ELECTROPHOTOGRAPHIC PHOTORECEPTOR, AND APPARATUS OF FORMING ELECTROPHOTOGRAPHIC IMAGE

(71) Applicant: Konica Minolta, Inc., Tokyo (JP)

(72) Inventors: Mari Ueda, Mitaka (JP); Toshiyuki Fujita, Hachioji (JP); Haruo Horiguchi, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/635,949

(22) Filed: Jun. 28, 2017

(65) Prior Publication Data

US 2018/0024450 A1 Jan. 25, 2018

(30) Foreign Application Priority Data

Jul. 22, 2016 (JP) ..... 2016-143980

(51) Int. Cl.

| | |
|---|---|
| ***G03G 5/147*** | (2006.01) |
| ***G03G 5/05*** | (2006.01) |
| ***G03G 5/047*** | (2006.01) |
| ***G03G 5/06*** | (2006.01) |
| ***G03G 5/10*** | (2006.01) |
| ***G03G 15/00*** | (2006.01) |

(52) U.S. Cl.

CPC ..... *G03G 5/14717* (2013.01); *G03G 5/047* (2013.01); *G03G 5/0507* (2013.01); *G03G 5/0525* (2013.01); *G03G 5/0532* (2013.01); *G03G 5/0542* (2013.01); *G03G 5/0546* (2013.01); *G03G 5/0614* (2013.01); *G03G 5/0696* (2013.01); *G03G 5/102* (2013.01); *G03G 5/14704* (2013.01); *G03G 5/14734* (2013.01); *G03G 15/75* (2013.01)

(58) Field of Classification Search

CPC ..... G03G 5/14704; G03G 5/14717; G03G 5/1473; G03G 5/14734; G03G 5/0507; G03G 5/0546; G03G 5/0532; G03G 5/0525; G03G 5/047

USPC ..... 430/59.6, 66, 73, 58.85, 130, 132, 133

See application file for complete search history.

(56) References Cited

U.S. PATENT DOCUMENTS

| | | | | |
|---|---|---|---|---|
| 6,818,368 | B2 * | 11/2004 | Tanaka | G03G 5/043 399/115 |
| 8,889,325 | B2 * | 11/2014 | Konishi | G03G 5/14734 430/58.75 |
| 8,962,226 | B2 * | 2/2015 | Maeda | G03G 5/14704 430/66 |
| 2005/0169668 | A1 * | 8/2005 | Koichi | G03G 21/0029 399/149 |
| 2005/0221210 | A1 * | 10/2005 | Suzuki | G03G 5/0542 430/58.15 |

FOREIGN PATENT DOCUMENTS

JP 2013061625 A 4/2013

OTHER PUBLICATIONS

American Chemical Society (ACS) File Registry No. RN 65894-76-0 on STN, copyright 2017, which was entered in STN on Nov. 16, 1984.*

* cited by examiner

*Primary Examiner* — Janis L Dote
(74) *Attorney, Agent, or Firm* — Lucas & Mercanti, LLP

(57) ABSTRACT

Provided is an electrophotographic photoreceptor including a conductive support, a photosensitive layer, and a surface protective layer disposed in sequence. The surface protective layer includes a cured product of a composition containing a polymerizable compound, a charge transporting material, and at least two polymerization initiators. The polymerization initiators include an acyl phosphine oxide and an O-acyl oxime.

9 Claims, 2 Drawing Sheets

ELECTROPHOTOGRAPHIC PHOTORECEPTOR, METHOD OF PRODUCING ELECTROPHOTOGRAPHIC PHOTORECEPTOR, AND APPARATUS OF FORMING ELECTROPHOTOGRAPHIC IMAGE

CROSS-REFERENCE TO RELATED APPLICATIONS

The present U.S. patent application claims a priority under the Paris Convention of Japanese Patent Application No. 2016-143980 filed on Jul. 22, 2016, the entirety of which is incorporated herein by references.

BACKGROUND

Technological Field

The present invention relates to an electrophotographic photoreceptor, a method of producing the photoreceptor, and an apparatus of forming an electrophotographic image. In particular, the present invention relates to an electrophotographic photoreceptor that can achieve the compatibility between a reduction in residual image formation and high wear resistance while maintaining durability, a method of producing the photoreceptor, and an apparatus of forming an electrophotographic image.

Description of the Related Art

In recent years, a demand has arisen for development of a maintenance-free electrophotographic image-forming apparatus exhibiting an increased printing rate and having a reduced size. In association with such a demand, a cylindrical electrophotographic photoreceptor for use in the electrophotographic image-forming apparatus has been required to have a reduced diameter (size) and to exhibit high durability. An organic photoreceptor (hereinafter may be referred to simply as "photoreceptor"), which has been generally used as an electrophotographic photoreceptor, includes a photosensitive layer composed of, for example, a charge transporting material and a binder resin. The photosensitive layer is likely to be worn by a mechanical load and thus shortens the service life of the photoreceptor.

The photoreceptor is required to have improved wear resistance for enhancing its durability. Thus, studies have been made on a technique for disposing a surface protective layer on the photosensitive layer. For example, a technique has been proposed for providing a surface protective layer with high wear resistance. The technique involves addition of a curable binder resin and metal oxide microparticles into the surface protective layer.

Another technique has been proposed for preventing impairment of electrical properties caused by application of the surface protective layer. The technique involves incorporation of a charge transporting material into the surface protective layer for providing the layer with charge transporting ability.

On the basis of these two techniques, a technique has been proposed which involves incorporation of N-type metal oxide microparticles and a charge transporting material into the surface protective layer for an improvement in wear resistance and a reduction in residual image formation (refer to, for example, Japanese Unexamined Patent Application Publication No. 2013-061625).

Unfortunately, the charge transporting material incorporated into the surface protective layer in these proposed techniques has low hole transporting ability and cannot achieve a sufficient reduction in residual image formation under severe conditions. The incorporation of a charge transporting material having high hole transporting ability is desired for a sufficient reduction in residual image formation; however, such a charge transporting material absorbs light within the optical absorption wavelength range of a polymerization initiator used for the curing reaction of the surface protective layer. Thus, the incorporation of such a charge transporting material probably causes a reduction in the hardness of the surface protective layer, resulting in impaired wear resistance.

SUMMARY

The present invention has been attained in consideration of the problems and circumstances described above. An object of the present invention is to provide an electrophotographic photoreceptor that can achieve the compatibility between a reduction in residual image formation and high wear resistance while maintaining durability. Another object of the present invention is to provide a method of producing the photoreceptor. Still another object of the present invention is to provide an apparatus of forming an electrophotographic image.

In order to solve the aforementioned problems, the present inventors, who have conducted studies on the cause of the problems, have consequently found that the incorporation of at least two polymerization initiators: an acyl phosphine oxide having high internal curability and an O-acyl oxime having high reactivity into a surface protective layer containing a charge transporting material leads to an electrophotographic photoreceptor that can achieve the compatibility between a reduction in residual image formation and high wear resistance while maintaining durability. The present invention has been accomplished on the basis of this finding.

In order to achieve the abovementioned objects, according to an aspect of the present invention, there is provided an electrophotographic photoreceptor including a conductive support, a photosensitive layer, and a surface protective layer disposed in sequence, wherein the surface protective layer includes a cured product of a composition containing a polymerizable compound, a charge transporting material, and at least two polymerization initiators; and the polymerization initiators include an acyl phosphine oxide and an O-acyl oxime.

According to another aspect of the present invention, there is provided a method of producing an electrophotographic photoreceptor including a conductive support, a photosensitive layer, and a surface protective layer disposed in sequence, the method including forming the surface protective layer by curing a composition containing a polymerizable compound, a charge transporting material, and at least two polymerization initiators, wherein the polymerization initiators includes an acyl phosphine oxide and an O-acyl oxime.

According to another aspect of the present invention, there is provided an apparatus of forming an electrophotographic image, the apparatus including an electrophotographic photoreceptor, a charging unit to charge the electrophotographic photoreceptor, an exposing unit, a developing unit, and a transferring unit, wherein the electrophotographic photoreceptor is the electrophotographic photoreceptor according to the present invention.

BRIEF DESCRIPTION OF THE DRAWING

The advantages and features provided by one or more embodiments of the invention will become more fully understand from the detailed description given hereinbelow and the appended drawings which are given by way of illustration only, and thus are not intended as a definition of the limits of the present invention, and wherein.

DETAILED DESCRIPTION OF EMBODIMENTS

Figure 1:
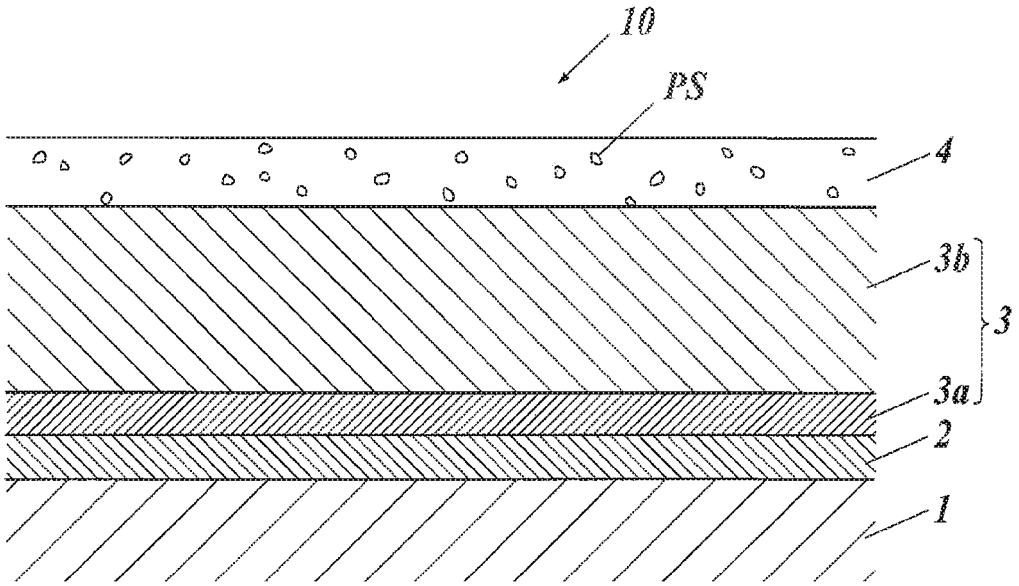
FIG. 1 is a schematic cross-sectional view of an exemplary configuration of the electrophotographic photoreceptor of the present invention.

The electrophotographic photoreceptor of the present invention includes a conductive support, a photosensitive layer, and a surface protective layer disposed in sequence. The surface protective layer contains a cured product of a composition containing a polymerizable compound, a charge transporting material, and at least two polymerization initiators. The polymerization initiators are an acyl phosphine oxide and an O-acyl oxime. These technical characteristics are common to the aspects of the present invention.

In an embodiment of the present invention, the O-acyl oxime polymerization initiator preferably has a structure represented by Formula (1). An O-acyl oxime having a structure represented by Formula (1) (sulfide structure) generates by-products exhibiting electrical properties superior to those of by-products generated from an O-acyl oxime having a carbazole structure. Thus, the use of the O-acyl oxime polymerization initiator in combination with the acyl phosphine oxide can prevent impairment of electrical properties, resulting in a further reduction in residual image formation.

The ratio of the amount A of the acyl phosphine oxide to the amount B of the O-acyl oxime is preferably 3:7 to 8:2. A ratio of A to B within the above range leads to a reduction in amount of by-products derived from the O-acyl oxime, resulting in prevention of impaired electrical properties. In addition, a ratio of A to B within the above range leads to high wear resistance without causing poor curing reaction rate.

The charge transporting material preferably exhibits a maximum absorption wavelength of 405±50 nm in an absorption spectrum. A maximum absorption wavelength within the above range leads to improved hole transporting ability and thus improved electrical properties, resulting a reduction in residual image formation.

The surface protective layer preferably contains metal oxide particles for enhancing the durability of the photoreceptor.

The metal oxide particles preferably have a reactive organic group for enhancing the hardness and elastic deformation rate (i.e., wear resistance) of the surface protective layer.

The present invention provides a method of producing an electrophotographic photoreceptor including a conductive support, a photosensitive layer, and a surface protective layer disposed in sequence, the method involving a step of forming the surface protective layer by curing a composition containing a polymerizable compound, a charge transporting material, and at least two polymerization initiators, wherein the polymerization initiators are an acyl phosphine oxide and an O-acyl oxime. This method can produce an electrophotographic photoreceptor that achieves the compatibility between a reduction in residual image formation and high wear resistance while maintaining durability.

The electrophotographic photoreceptor of the present invention is suitable for use in an apparatus of forming an electrophotographic image, the apparatus including a charging unit to charge the electrophotographic photoreceptor, an exposing unit, a developing unit, and a transferring unit.

The components of the present invention and embodiments and aspects for implementing the present invention will now be described in detail. As used herein, the term "to" between two numerical values indicates that the numeric values before and after the term are inclusive as the lower limit value and the upper limit value, respectively.

[Electrophotographic Photoreceptor]

The electrophotographic photoreceptor of the present invention includes a conductive support, a photosensitive layer, and a surface protective layer disposed in sequence. The surface protective layer contains a cured product of a composition containing a polymerizable compound, a charge transporting material, and at least two polymerization initiators. The polymerization initiators are an acyl phosphine oxide and an O-acyl oxime.

The photosensitive layer has both a function of absorbing light to generate charges and a function of transporting charges. The photosensitive layer may have a single-layer configuration containing a charge generating material and a charge transporting material, or may have a multilayer configuration including a charge generating sublayer containing a charge generating material and a charge transporting sublayer containing a charge transporting material. An intermediate layer may optionally be disposed between the conductive support and the photosensitive layer. The photosensitive layer may have any layer configuration. Specific examples of the layer configuration including a surface protective layer are as follows:

(1) A layer configuration including a conductive support, a photosensitive layer, and a surface protective layer disposed in sequence, the photosensitive layer including a charge generating sublayer and a charge transporting sublayer.

(2) A layer configuration including a conductive support, a single photosensitive layer containing a charge transporting material and a charge generating material, and a surface protective layer disposed in sequence.

(3) A layer configuration including a conductive support, an intermediate layer, a photosensitive layer, and a surface protective layer disposed in sequence, the photosensitive layer including a charge generating sublayer and a charge transporting sublayer.

(4) A layer configuration including a conductive support, an intermediate layer, a single photosensitive layer containing a charge transporting material and a charge generating material, and a surface protective layer disposed in sequence.

The electrophotographic photoreceptor of the present invention may have any of the aforementioned layer configurations (1) to (4). Of these, particularly preferred is layer configuration (3).

FIG. 1 is a cross-sectional view of an exemplary layer configuration of the electrophotographic photoreceptor of the present invention.

As illustrated in FIG. 1, the electrophotographic photoreceptor 10 of the present invention includes a conductive support 1, an intermediate layer 2, a photosensitive layer 3, and a surface protective layer 4 disposed in sequence.

The photosensitive layer 3 includes a charge generating sublayer 3*a* and a charge transporting sublayer 3*b*.

The surface protective layer 4 contains metal oxide particles PS.

The electrophotographic photoreceptor of the present invention is an organic photoreceptor. The "organic receptor" refers to an electrophotographic photoreceptor wherein an organic compound exhibits at least one of charge generating and charge transporting functions essential for the photoreceptor. Examples of the organic receptor include a photoreceptor composed of a known organic charge generating or transporting material, and a photoreceptor composed of a polymer complex exhibiting charge generating and charge transporting functions.

<Surface Protective Layer>

The surface protective layer according to the present invention contains a polymerizable compound (binder resin), a charge transporting material, and polymerization initiators. The surface protective layer according to the present invention may contain metal oxide particles. The materials for the surface protective layer will be described below.

<<Polymerization Initiator>>

The surface protective layer according to the present invention contains at least two polymerization initiators: an acyl phosphine oxide and an O-acyl oxime.

Examples of the acyl phosphine oxide are described below.

IRGACURE TPO

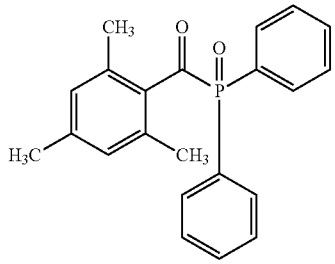

IRGACURE 819

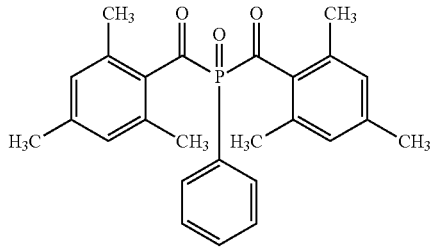

IRGACURE 819 is preferred among IRGACURE TPO (Irg TPO) and IRGACURE 819 (Irg 819) described above.

In the present invention, the O-acyl oxime polymerization initiator preferably has a structure represented by Formula (1).

Formula (1)

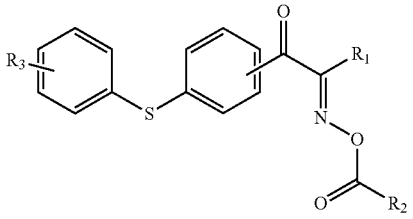

In Formula (1), $R_1$ and $R_2$ each represent a moiety selected from the group consisting of a hydrogen atom, an alkyl group having one to six carbon atoms and optionally having a substituent, a cycloalkyl group having three to six carbon atoms and optionally having a substituent, and an aryl group optionally having a substituent.

$R_3$ represents a moiety selected from the group consisting of a hydrogen atom, an alkyl group having one to six carbon atoms and optionally having a substituent, an alkoxy group having one to six carbon atoms and optionally having a substituent, an aryl group optionally having a substituent, a halogen atom, a cyano group, a nitro group, a hydroxy group, and a carbonyl group optionally having a substituent.

Examples of the compound having a structure represented by Formula (1) are described below.

(OXE01)

B-1

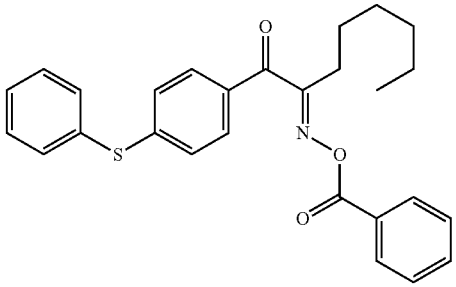

B-2

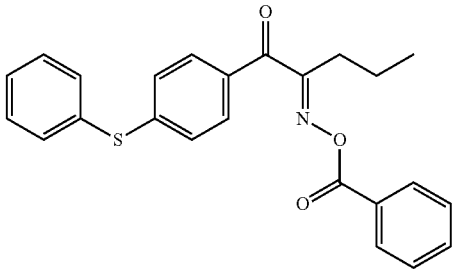

B-3

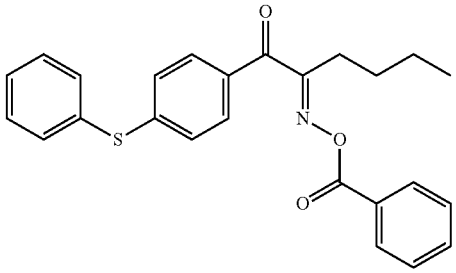

-continued
B-4
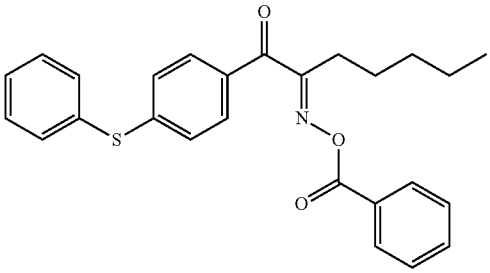
B-5
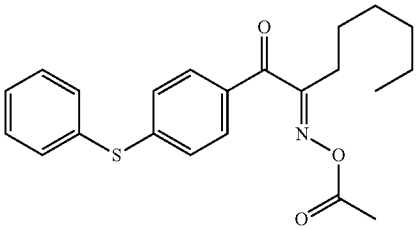
B-6
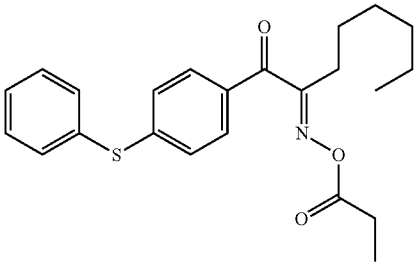
B-7
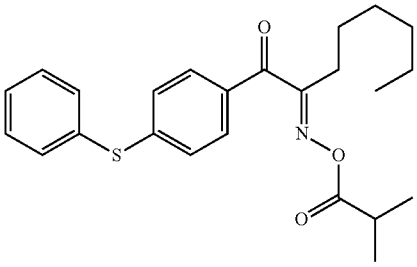
B-8
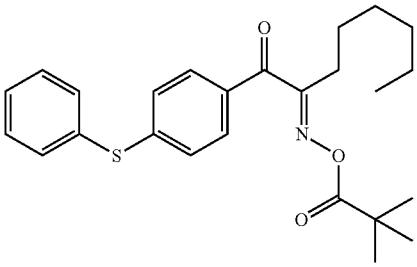
-continued
B-9
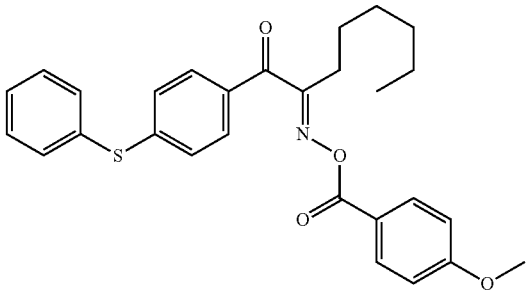
B-10
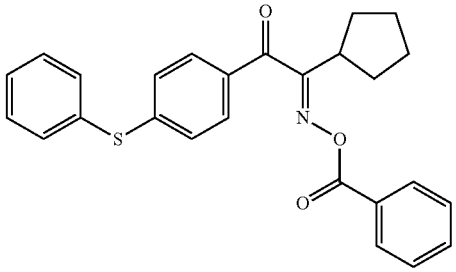
B-11
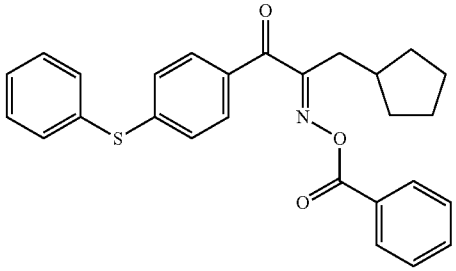
B-12
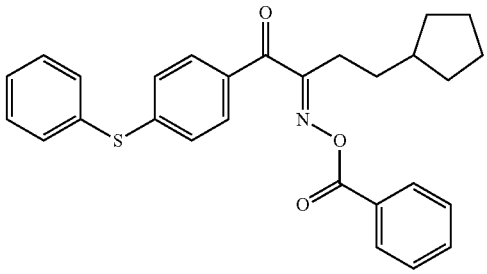
B-13
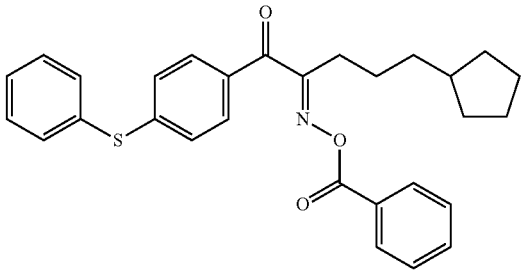

-continued
B-14
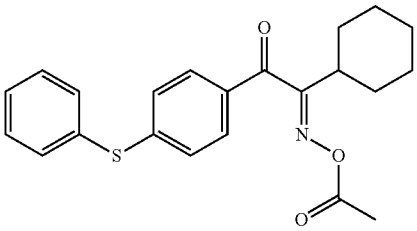
B-15
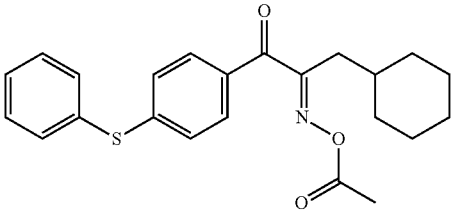
B-16
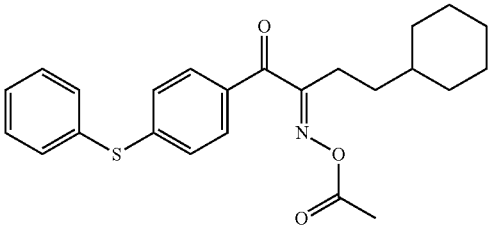
B-17
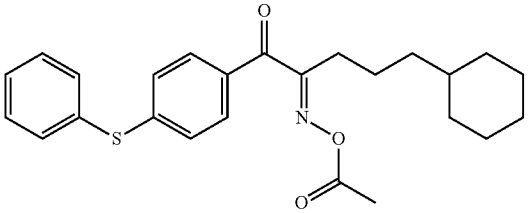
B-18
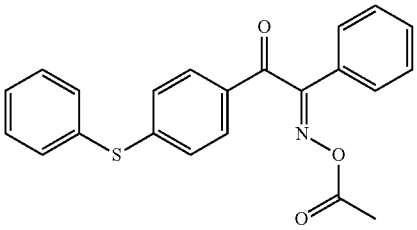
B-19
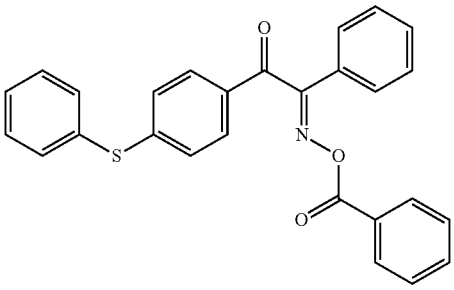
-continued
B-20
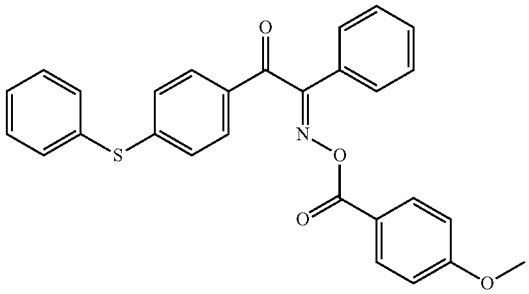
B-21
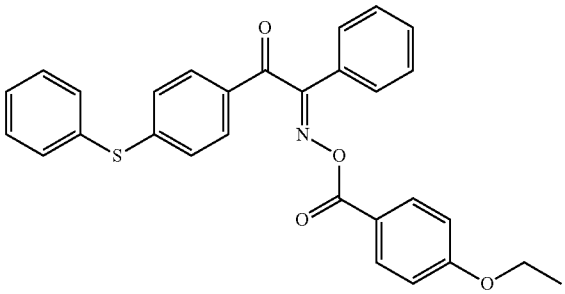
B-22
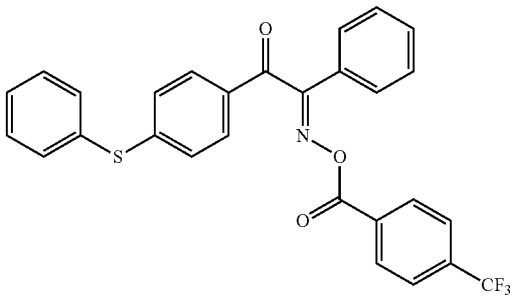
B-23
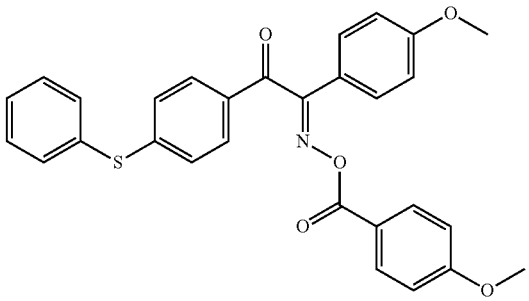
B-24
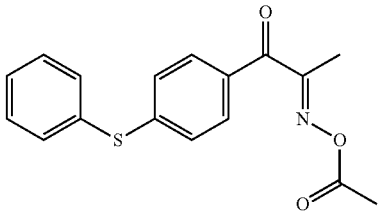

-continued
B-25
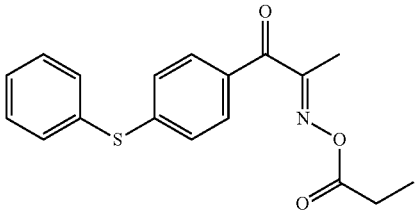
B-26
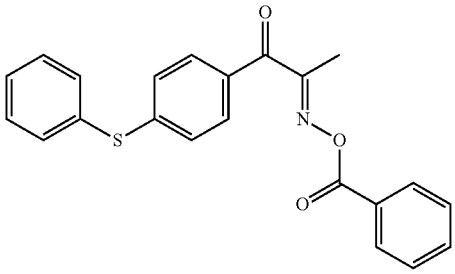
B-27
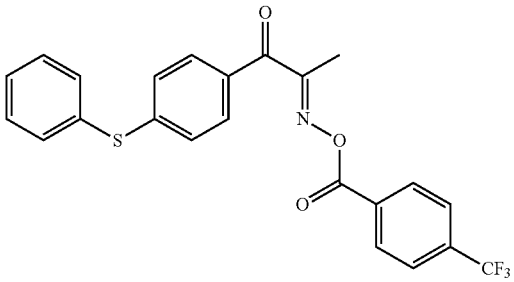
B-28
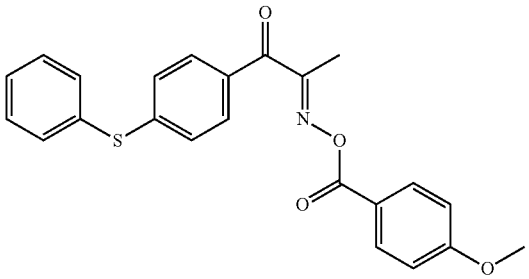
B-29
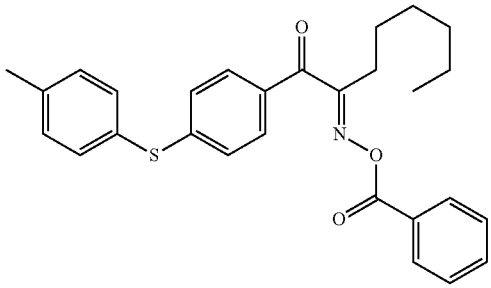
-continued
B-30
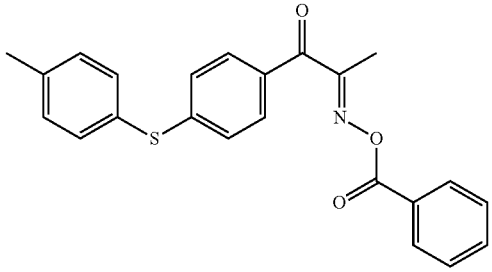
B-31
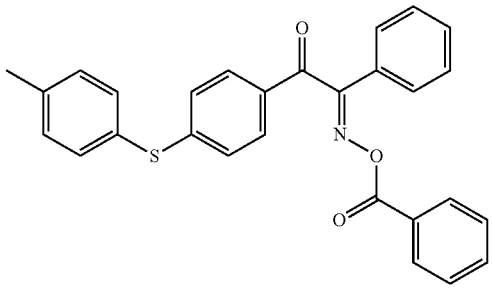
B-32
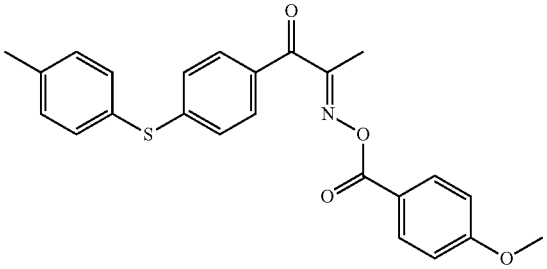
B-33
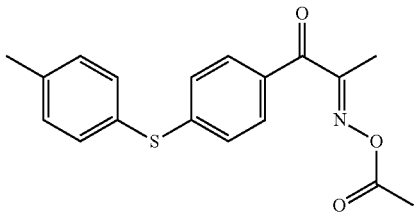
B-34
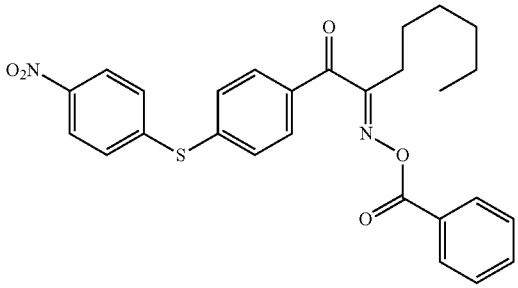

-continued

B-35

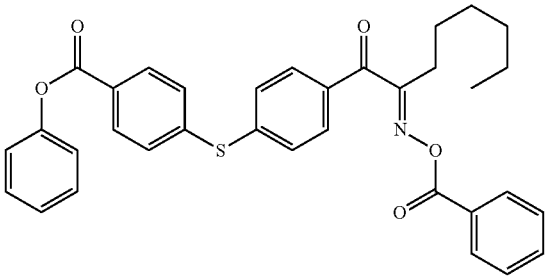

B-36

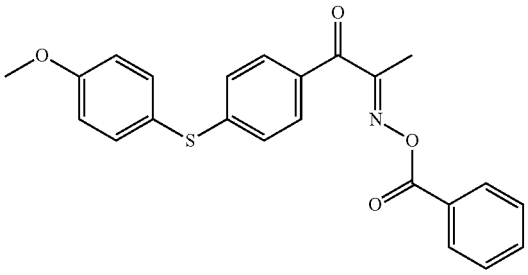

B-37

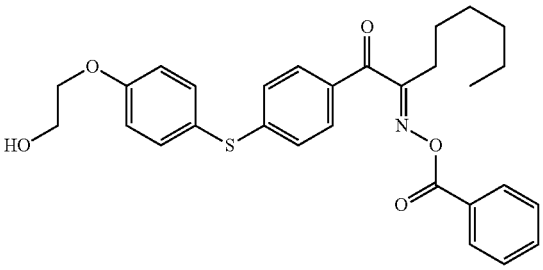

B-38

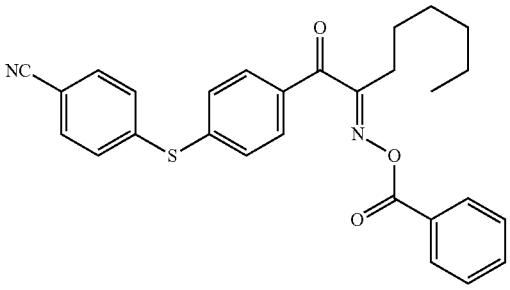

B-39

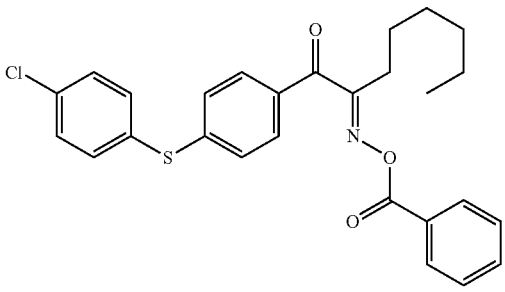

-continued (OXE02)

B-40

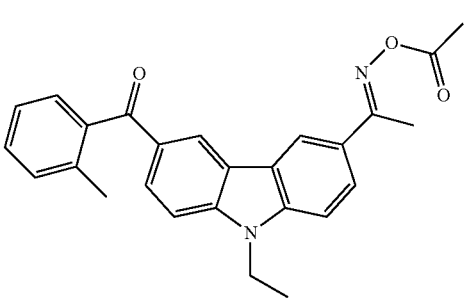

In the present invention, the ratio of the amount A of the acyl phosphine oxide to the amount B of the O-acyl oxime is preferably 3:7 to 8:2, more preferably 5:5 to 7:3.

A ratio of A to B of 3:7 or more leads to a reduction in amount of by-products derived from the O-acyl oxime (i.e., hole-trapping components), resulting in prevention of impaired electrical properties. A ratio of A to B of 8:2 or less leads to prevention of a reduction in curing reaction rate (which may occur due to an excessively large amount of the acyl phosphine oxide), resulting in high wear resistance.

In the present invention, the surface protective layer, which contains at least the acyl phosphine oxide and the O-acyl oxime, may contain three or more polymerization initiators.

The polymerization initiators may be photopolymerization initiators or thermal polymerization initiators.

The amount of the polymerization initiators is preferably 0.1 to 20 parts by mass, more preferably 0.5 to 10 parts by mass, relative to 100 parts by mass of the polymerizable compound.

Examples of commercially available products of the O-acyl oxime polymerization initiator include exemplary compound B-1 (IRGACURE OXE01) and exemplary compound B-40 (IRGACURE OXE02) (manufactured by BASF Japan Ltd.) and PBG-305 and PBG-329, which are O-acyl oxime initiators having a sulfide structure (manufactured by Changzhou Tronly New Electronic Materials Co., Ltd.).

<<Polymerizable Compound>>

The polymerizable compound is preferably a monomer that is polymerized (cured) through irradiation with actinic rays (e.g., ultraviolet rays or electron beams) into a common binder resin (e.g., polystyrene or polyacrylate) for use in a photoreceptor.

In the present invention, the polymerizable compound contained in the surface protective layer is preferably a crosslinkable polymerizable compound for maintaining high durability.

The crosslinkable polymerizable compound is, for example, a polymerizable compound having two or more radically polymerizable functional groups (hereinafter may be referred to as "polyfunctional radically polymerizable compound").

The crosslinkable polymerizable compound may be a combination of a polyfunctional radically polymerizable compound with a compound having one radically polymerizable functional group (hereinafter may be referred to as "monofunctional radically polymerizable compound"). If a monofunctional radically polymerizable compound is used, the amount of the compound is preferably 20 mass % or less relative to the total amount of monomers for forming the binder resin.

Examples of the radically polymerizable functional group include a vinyl group, an acryloyl group, and a methacryloyl group.

Examples of the particularly preferred polyfunctional radically polymerizable compounds include acrylic monomers having two or more acryloyl groups ($CH_2{=}CHCO{-}$) or methacryloyl groups ($CH_2{=}CCH_3CO{-}$), which are radically polymerizable functional groups, and oligomers derived from the monomers. These monomers and oligomers can be cured with a small amount of light or within a short period of time. Thus, the resin is preferably an acrylic resin formed of an acrylic monomer or an oligomer derived therefrom.

In the present invention, polyfunctional radically polymerizable compounds may be used alone or in combination. Such a polyfunctional radically polymerizable compound may be a monomer or an oligomer derived therefrom.

Examples of the polyfunctional radically polymerizable compound are described below.

M1

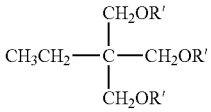

M2

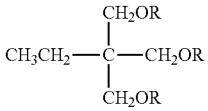

M3

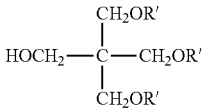

M4

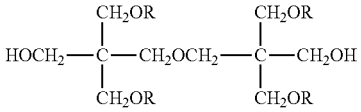

M5

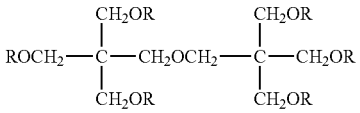

M6

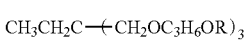

M7

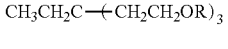

M8

M9

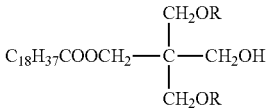

M10

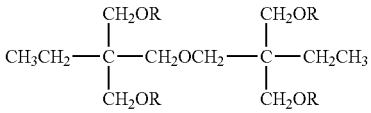

M11

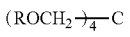

-continued

M12

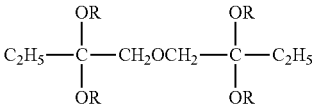

M13

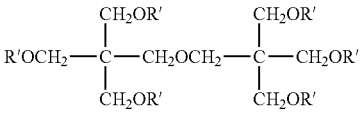

M14

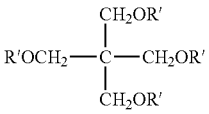

In the formulae representing exemplary compounds M1 to M14, R represents an acryloyl group ($CH_2{=}CHCO{-}$), and R' represents a methacryloyl group ($CH_2{=}CCH_3CO{-}$).

<<Charge Transporting Material>>

The surface protective layer according to the present invention contains a charge transporting material.

The charge transporting material may be of a common type having a charge transporting function, and preferably has a molecular weight of 250 to 800. A charge transporting material having a molecular weight of 250 or more can prevent a reduction in charge transporting function, resulting in sufficient reduction in residual image formation. A charge transporting material having a molecular weight of 800 or less leads to easy maintenance of the surface hardness of the surface protective layer.

The charge transporting material according to the present invention preferably exhibits a maximum absorption wavelength of 405±50 nm in an absorption spectrum. A maximum absorption wavelength within the above range leads to improved hole transporting ability, resulting a reduction in residual image formation.

In general, the polymerization initiator for curing (polymerization) reaction in the surface protective layer cannot receive the energy required for UV curing in the case of the use of a charge transporting material that absorbs light around 405 nm (the optical absorption wavelength of the polymerization initiator); i.e., the use of a charge transporting material having high hole transporting ability. Thus, the use of such a charge transporting material results in insufficient curing. In contrast, the present invention involves the use of the acyl phosphine oxide in combination with the O-acyl oxime polymerization initiator having high reactivity. This combination use can achieve the polymerization reaction without causing impaired electrical properties nor insufficient curing, resulting in the compatibility between a reduction in residual image formation and high wear resistance.

In the present invention, the maximum absorption wavelength was measured in the form of a solution with a spectrophotometer.

Non-limiting examples of the charge transporting material (compound) usable in the present invention are described below.

| Example of Material | Structure | Maximum Absorption Wavelength [nm] |
|---|---|---|
| CTM-1 | 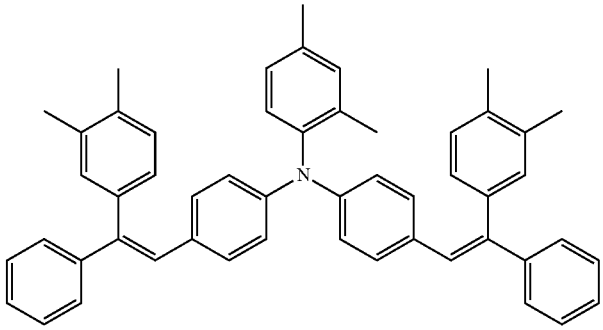 | 384 |
| CTM-2 | 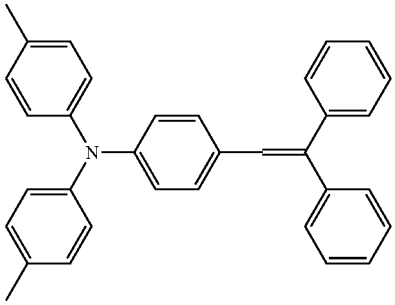 | 370 |
| CTM-3 | 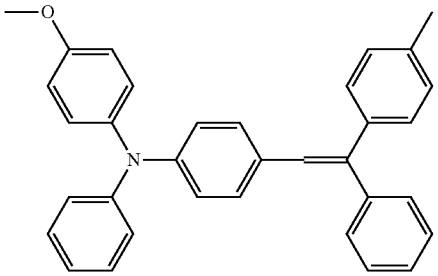 | 368 |
| CTM-4 | 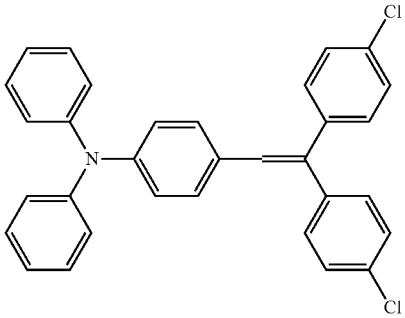 | 375 |

-continued
| | | |
|---|---|---|
| CTM-5 | 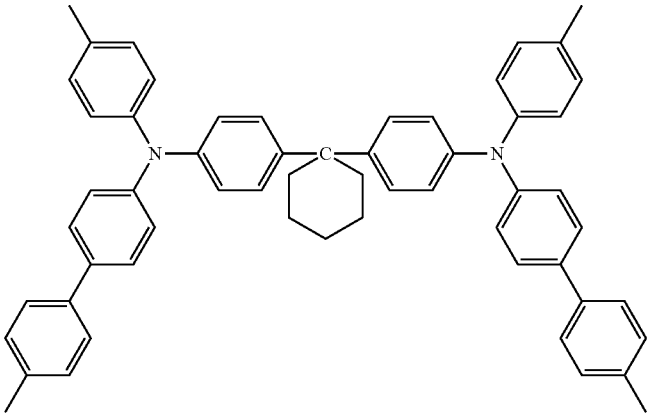 | 319 |
| CTM-6 | 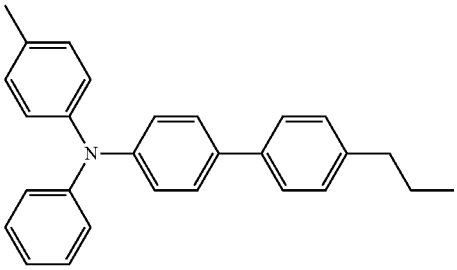 | 320 |
| Example of Material | Structure | Molecular Weight |
|---|---|---|
| CTM-101 | 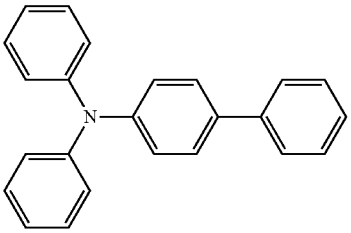 | 321.41 |
| CTM-102 | 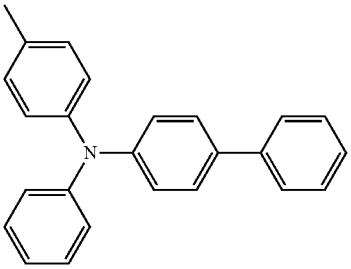 | 335.44 |
| CTM-103 | 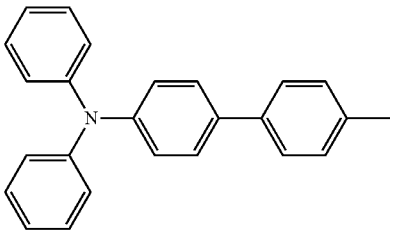 | 335.44 |

-continued
| | | |
|---|---|---|
| CTM-104 | 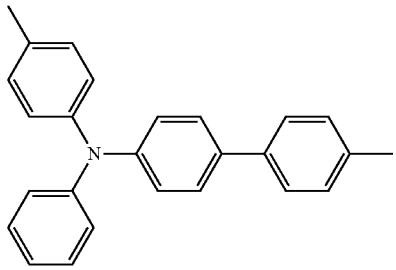 | 349.47 |
| CTM-105 | 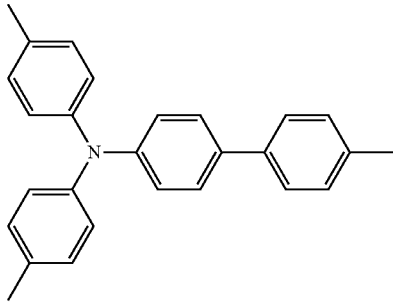 | 363.49 |
| CTM-106 | 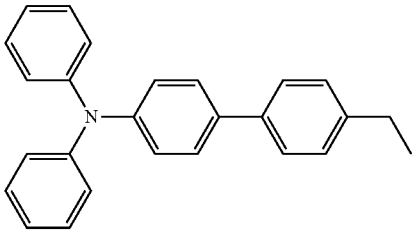 | 349.47 |
| CTM-107 | 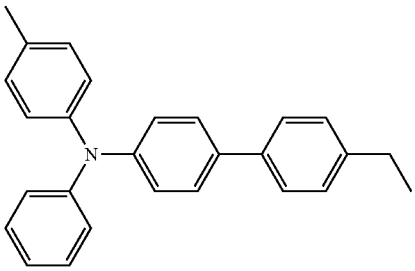 | 363.49 |
| CTM-108 | 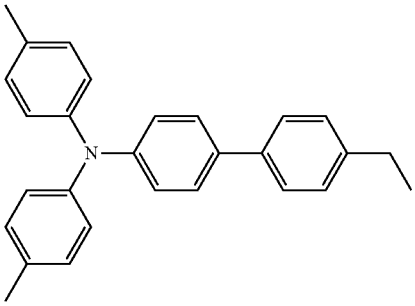 | 377.52 |

-continued
| | | |
|---|---|---|
| CTM-109 | 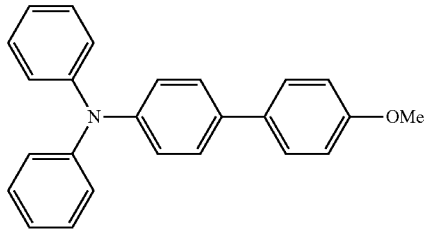 | 351.44 |
| CTM-110 | 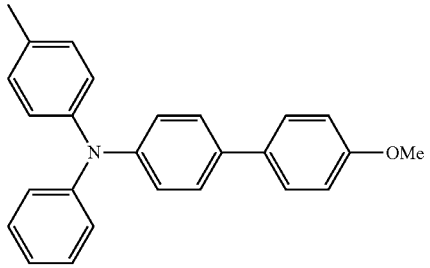 | 365.47 |
| CTM-111 | 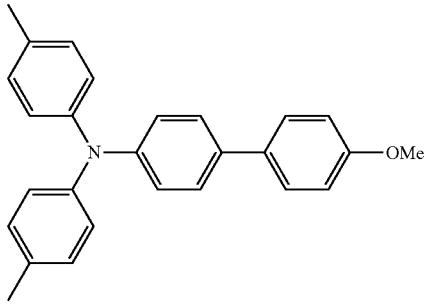 | 379.49 |
| CTM-112 | 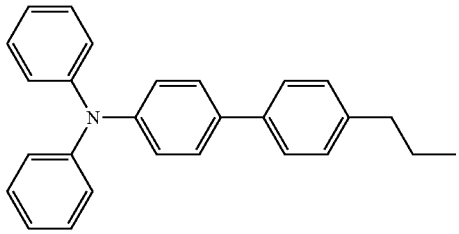 | 363.49 |
| CTM-114 | 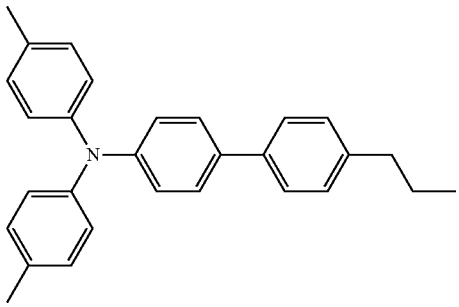 | 391.55 |
| CTM-115 | 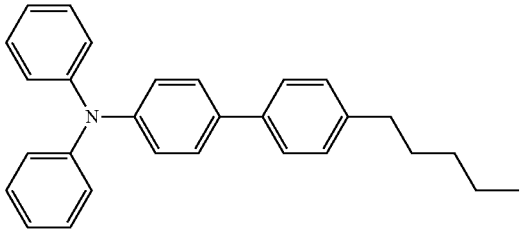 | 391.55 |

-continued
CTM-116
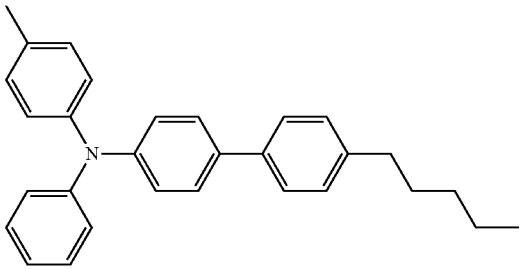
405.57
CTM-117
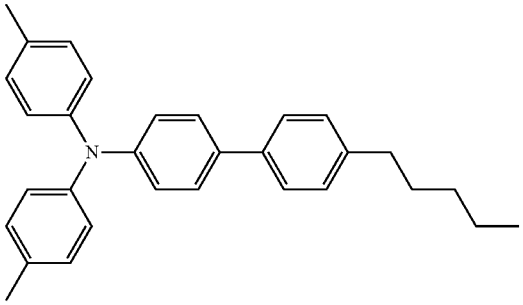
419.60
CTM-118
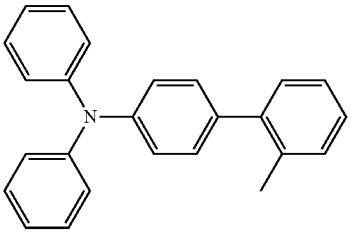
335.44
CTM-119
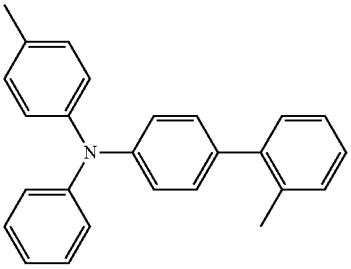
349.47
CTM-120
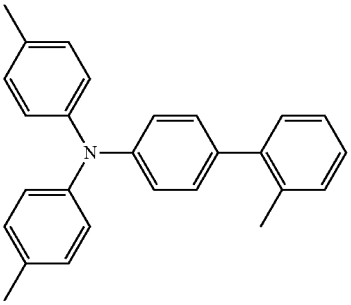
363.49

-continued
CTM-121 349.47
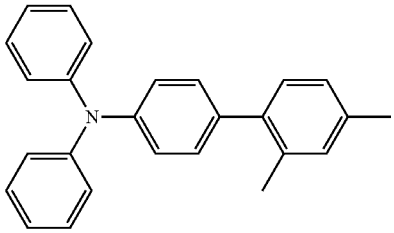
CTM-122 335.44
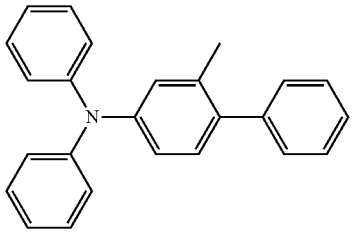
CTM-131 626.87
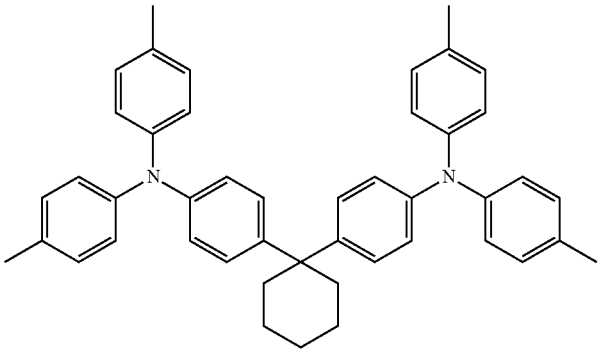
CTM-133 807.12
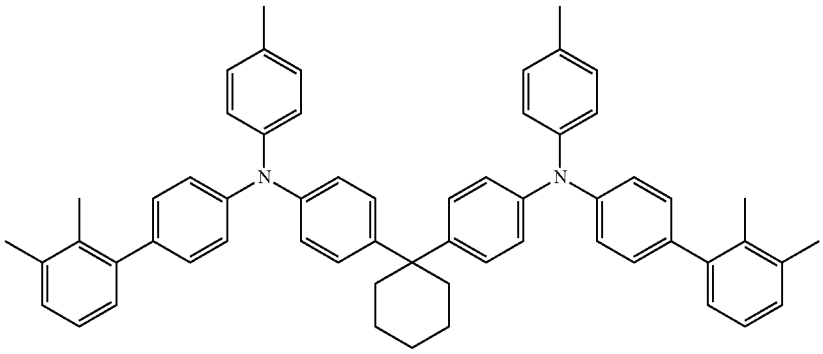
CTM-134 779.06
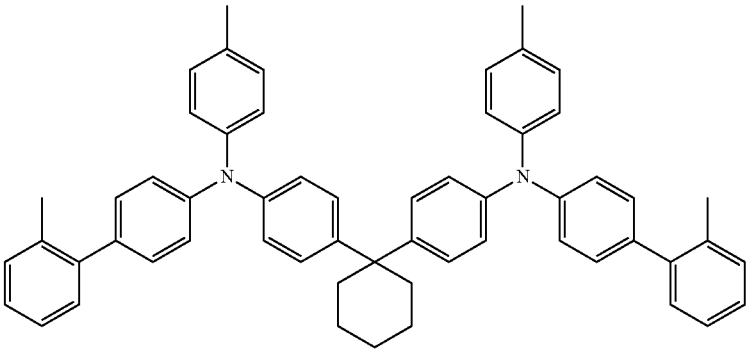

-continued
CTM-141 505.69
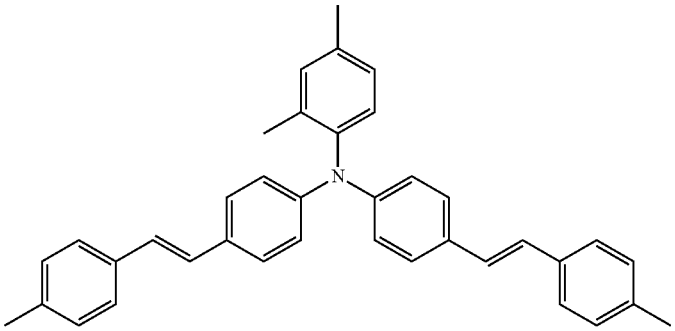
CTM-143 699.96
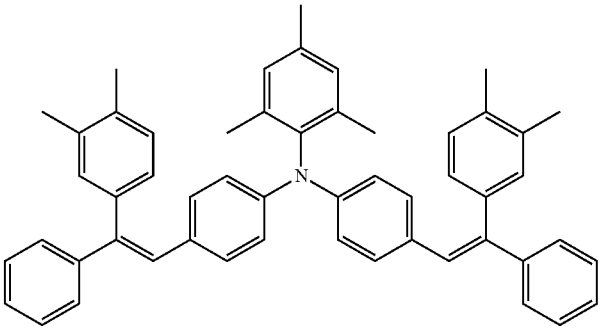
CTM-144 544.73
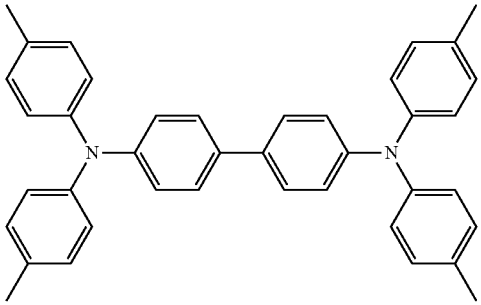
CTM-145 465.63
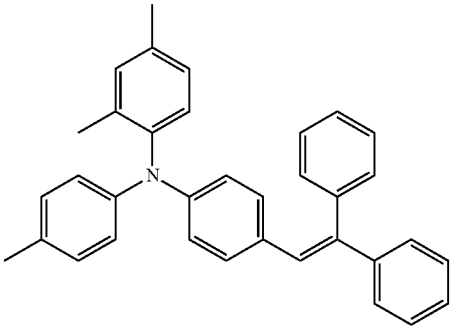
CTM-146 361.48
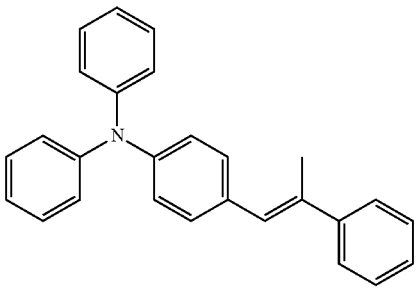

-continued

| | | |
|---|---|---|
| CTM-147 | 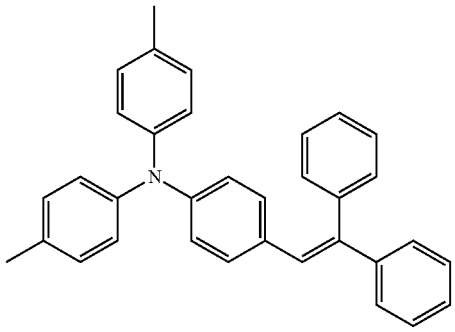 | 451.60 |
| CTM-148 | 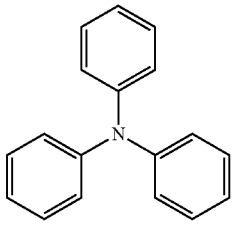 | 245.32 |
| CTM-149 | 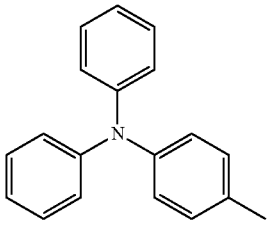 | 259.34 |

The aforementioned charge transporting material can be synthesized by any known process; for example, the process described in Japanese Unexamined Patent Application Publication No. 2006-143720.

The molecular weight of the charge transporting material is displayed with two-digit accuracy after the decimal point.

<<Metal Oxide Particles>>

In the present invention, the surface protective layer preferably contains metal oxide particles.

The metal oxide particles according to the present invention are preferably microparticles of a metal oxide (inclusive of a transition metal oxide). Examples of the metal oxide particles include microparticles of metal oxides, such as silica (silicon dioxide), magnesium oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Particularly preferred are microparticles of any of tin oxide, titanium oxide, zinc oxide, and alumina. The use of such microparticles can improve the wear resistance of the surface protective layer.

The metal oxide particles are preferably prepared by a generally known process, such as the gas-phase process, the chlorine process, the sulfuric acid process, the plasma process, or the electrolytic process.

The metal oxide particles have a number average primary particle size of preferably 1 to 300 nm, particularly preferably 3 to 100 nm.

(Determination of Metal Oxide Particle Size)

The particle size (number average primary particle size) of the metal oxide particles is determined as follows: The particles are photographed at a magnification of 10,000 with a scanning electron microscope (manufactured by JEOL Ltd.), and the photographic image including randomly selected 300 particles (excluding agglomerated particles) read by a scanner is converted into a binary image with an automatic image analyzer "LUZEX (registered trademark) AP" with software version Ver. 1.32 (manufactured by NIRECO Corporation). The horizontal Feret's diameters of the particles are calculated, and the average value of the Feret's diameters is defined as the number average primary particle size. As used herein, the "horizontal Feret's diameter" refers to the length of a side (parallel to the x-axis) of a rectangle circumscribing a binarized image of a metal oxide particle.

(Surface Modification)

In the present invention, the metal oxide particles preferably have a reactive organic group. In specific, the surfaces of the metal oxide particles are preferably modified with a surface modifier having a reactive organic group from the viewpoint of dispersibility.

The surface modifier may be reactive with, for example, a hydroxy group present on the surfaces of unmodified metal oxide particles. Examples of such a surface modifier include silane coupling agents and titanium coupling agents.

In the present invention, a surface modifier having a reactive organic group is preferably used for further enhancing the hardness of the surface protective layer. The reactive organic group is more preferably a radically polymerizable functional group. If the binder resin for the surface protective layer is a cured resin derived from a polymerizable compound, the surface modifier having a radically polymerizable functional group can also react with the polymerizable compound, to form a strong protective film.

The surface modifier having a radically polymerizable functional group is preferably a silane coupling agent having an acryloyl or methacryloyl group. Examples of the surface modifier having such a radically polymerizable functional group include known compounds described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{-}CHCOO(CH_2)_2Si(OC_2H_5)(OCH_3)_2$
S-7: $CH_2{=}CHCOO(CH_2)_3Si(OCH_3)_3$
S-8: $CH_2{-}CHCOO(CH_2)_2Si(CH_3)Cl_2$
S-9: $CH_2{=}CHCOO(CH_2)_2SiCl_3$
S-10: $CH_2{-}CHCOO(CH_2)_3Si(CH_3)Cl_2$
S-11: $CH_2{-}CHCOO(CH_2)_3SiCl_3$
S-12: $CH_2{-}C(CH_3)COO(CH_2)_2Si(CH_3)(OCH_3)_2$
S-13: $CH_2{-}C(CH_3)COO(CH_2)_2Si(OCH_3)_3$
S-14: $CH_2{=}C(CH_3)COO(CH_2)_3Si(CH_3)(OCH_3)_2$
S-15: $CH_2{-}C(CH_3)COO(CH_2)_3Si(OCH_3)_3$
S-16: $CH_2{-}C(CH_3)COO(CH_2)_2Si(CH_3)Cl_2$
S-17: $CH_2{-}C(CH_3)COO(CH_2)_2SiCl_3$
S-18: $CH_2{-}C(CH_3)COO(CH_2)_3Si(CH_3)Cl_2$
S-19: $CH_2{-}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{-}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Any surface modifier other than these compounds S-1 to S-36 may be used, and the surface modifier may be a silane compound having a reactive organic group capable of radical polymerization. These surface modifiers may be used alone or in combination.

The surface modifier may be used in any amount. The amount of the surface modifier is preferably 0.1 to 100 parts by mass relative to 100 parts by mass of unmodified metal oxide particles.

(Surface Modification of Metal Oxide Particles)

In specific, a slurry (suspension of solid particles) containing unmodified metal oxide particles and a surface modifier is subjected to wet milling, to micronize the metal oxide particles and to achieve surface modification of the particles. The solvent is then removed, followed by powderization, to prepare surface-modified metal oxide particles.

The slurry is preferably a mixture of unmodified metal oxide particles (100 parts by mass), a surface modifier (0.1 to 100 parts by mass), and a solvent (50 to 5,000 parts by mass).

A wet-media disperser is used for the wet milling of the slurry.

The wet-media disperser has a container loaded with media beads and a stirring disk mounted vertically to a rotary shaft. The stirring disk rapidly spins to mill and disperse agglomerated metal oxide particles. The disperser may be of any type that can sufficiently disperse the metal oxide particles during the surface modification of the metal oxide particles. Various types of the disperser may be used, such as a vertical type, a horizontal type, a continuous type, and a batch type. Specific examples of the disperser include a sand mill, an Ultravisco mill, a pearl mill, a grain mill, a Dyno mill, an agitator mill, and a dynamic mill. Such a disperser pulverizes and disperses particles by impact cracking, friction, shear force, or shear stress provided by grinding media, such as balls or beads.

The beads used in the wet-media disperser may be spheres composed of, for example, glass, alumina, zircon, zirconia, steel, or flint. Particularly preferred beads are composed of zirconia or zircon. Although the diameter of the beads is usually about 1 to 2 mm, a preferred diameter is about 0.1 to 1.0 mm in the present invention.

The disk and the inner wall of the container of the wet-media disperser may be formed of any material, such as stainless steel, nylon, or ceramic. In the present invention, the disk and the inner wall of the container are preferably formed of a ceramic material, such as zirconia or silicon carbide.

<<Other Additives>>

The surface protective layer according to the present invention may contain a component besides the radically polymerizable compound (binder resin), the charge transporting material, the polymerization initiator, and the metal oxide particles. For example, the surface protective layer may contain an antioxidant or lubricant particles (e.g., fluorine-containing resin particles). The fluorine-containing resin is preferably one or more resins appropriately selected from a tetrafluoroethylene resin, a trifluorochloroethylene resin, a hexafluoropropylene-chloroethylene resin, a vinyl fluoride resin, a vinylidene fluoride resin, a difluorodichloroethylene resin, and copolymers thereof. Particularly preferred are a tetrafluoroethylene resin and a vinylidene fluoride resin.

Now will be described the components of the photoreceptor other than the surface protective layer with reference to the aforementioned layer configuration (1); i.e., a layer configuration including the conductive support, the photosensitive layer, and the surface protective layer disposed in sequence, the photosensitive layer including a charge generating sublayer and a charge transporting sublayer.

<Conductive Support>

Any conductive support can be used for the electrophotographic photoreceptor of the present invention. Examples of the conductive support include drums and sheets formed of metals, such as aluminum, copper, chromium, nickel, zinc, and stainless steel; plastic films laminated with metal foil of aluminum or copper; plastic films provided with deposited layers of aluminum, indium oxide, or tin oxide; and metal and plastic films and paper sheets having conductive layers formed through application of a conductive substance alone or in combination with a binder resin.

<Intermediate Layer>

In the electrophotographic photoreceptor of the present invention, an intermediate layer having a barrier function and an adhesive function may be disposed between the conductive support and the photosensitive layer. The intermediate layer is preferably disposed for, for example, prevention of various failures.

The intermediate layer contains, for example, a binder resin (hereinafter may be referred to as "binder resin for intermediate layer") and optionally conductive particles or metal oxide particles.

Examples of the binder resin for intermediate layer include casein, poly(vinyl alcohol), nitrocellulose, ethylene-acrylic acid copolymers, polyamide resins, polyurethane resins, and gelatin. Of these, preferred are alcohol-soluble polyamide resins.

The intermediate layer may contain any conductive particulate or metal oxide particulate for controlling the resistance. Examples thereof include particles of metal oxides, such as alumina, zinc oxide, titanium oxide, tin oxide, antimony oxide, indium oxide, and bismuth oxide; and ultrafine particles of tin-doped indium oxide, antimony-doped tin oxide, and antimony-doped zirconium oxide.

Such metal oxide particles preferably have a number average primary particle size of 0.3 μm or less, more preferably 0.1 μm or less.

These particulate metal oxides may be used alone or in combination. A mixture of two or more particulate metal oxides may be in the form of solid solution or fusion.

The amount of the conductive particles or the metal oxide particles is preferably 20 to 400 parts by mass, more preferably 50 to 350 parts by mass, relative to 100 parts by mass of the binder resin for intermediate layer.

The intermediate layer has a thickness of preferably 0.1 to 15 μm, more preferably 0.3 to 10 μm.

<Charge Generating Sublayer>

The charge generating sublayer of the photosensitive layer according to the present invention contains a charge generating material and a binder resin (hereinafter may be referred to as "binder resin for charge generating sublayer").

Examples of the charge generating material include, but are not limited to, azo pigments, such as Sudan Red and Diane Blue; quinone pigments, such as pyrenequinone and anthanthrone; quinocyanine pigments; perylene pigments; indigo pigments, such as indigo and thioindigo; polycyclic quinone pigments, such as pyranthrone and diphthaloylpyrene; and phthalocyanine pigments. Of these, polycyclic quinone pigments and titanylphthalocyanine pigments are preferred.

These charge generating materials may be used alone or in combination.

Examples of the binder resin for charge generating sublayer include, but are not limited to, known resins, such as polystyrene resins, polyethylene resins, polypropylene resins, acrylic resins, methacrylic resins, vinyl chloride resins, vinyl acetate resins, poly(vinyl butyral) resins, epoxy resins, polyurethane resins, phenolic resins, polyester resins, alkyd resins, polycarbonate resins, silicone resins, melamine resins, copolymer resins containing two or more of these resins (e.g., vinyl chloride-vinyl acetate copolymer resins and vinyl chloride-vinyl acetate-maleic anhydride copolymer resins), and polyvinylcarbazole resins. Of these, poly(vinyl butyral) resins are preferred.

The amount of the charge generating material contained in the charge generating sublayer is preferably 1 to 600 parts by mass, more preferably 50 to 500 parts by mass, relative to 100 parts by mass of the binder resin for charge generating sublayer.

The thickness of the charge generating sublayer may vary depending on the properties of the charge generating material, the properties of the binder resin for charge generating sublayer, or the amount of the binder resin contained in the sublayer. The thickness is preferably 0.01 to 5 μm, more preferably 0.05 to 3 μm.

<Charge Transporting Sublayer>

The charge transporting sublayer of the photosensitive layer according to the present invention contains a charge transporting material and a binder resin (hereinafter may be referred to as "binder resin for charge transporting sublayer").

Examples of the charge transporting material contained in the charge transporting sublayer include triphenylamine derivatives, hydrazone compounds, styryl compounds, benzidine compounds, and butadiene compounds.

Examples of the binder resin for charge transporting sublayer include known resins, such as polycarbonate resins, polyacrylate resins, polyester resins, polystyrene resins, styrene-acrylonitrile copolymer resins, polymethacrylate resins, and styrene-methacrylate copolymer resins. Of these, polycarbonate resins are preferred. More preferred are polycarbonate resins, such as Bisphenol A (BPA)-based, Bisphenol Z (BPZ)-based, dimethyl BPA-based, and BPA-dimethyl BPA copolymer-based resins, from the viewpoints of cracking resistance, wear resistance, and charging characteristics.

The amount of the charge transporting material contained in the charge transporting sublayer is preferably 10 to 500 parts by mass, more preferably 20 to 250 parts by mass, relative to 100 parts by mass of the binder resin for charge transporting sublayer.

The thickness of the charge transporting sublayer may vary depending on the properties of the charge transporting material, the properties of the binder resin for charge transporting sublayer, or the amount of the binder resin contained in the sublayer. The thickness is preferably 5 to 40 μm, more preferably 10 to 30 μm.

The charge transporting sublayer may contain, for example, an antioxidant, an electron conductor, a stabilizer, or silicone oil. The antioxidant is preferably one disclosed in Japanese Unexamined Patent Application Publication No. 2000-305291. The electron conductor is preferably one disclosed in, for example, Japanese Unexamined Patent Application Publication No. S50-137543 or S58-76483.

<Production of Electrophotographic Photoreceptor>

The present invention provides a method of producing an electrophotographic photoreceptor including a conductive support, a photosensitive layer, and a surface protective layer disposed in sequence, the method involving a step of forming the surface protective layer by curing a composition containing a polymerizable compound, a charge transporting material, and at least two polymerization initiators, wherein the polymerization initiators are an acyl phosphine oxide and an O-acyl oxime.

The electrophotographic photoreceptor of the present invention can be produced through, for example, the steps described below.

Step (1): formation of an intermediate layer by application of a coating liquid for intermediate layer onto an outer surface of a conductive support, followed by drying.

Step (2): formation of a charge generating layer by application of a coating liquid for charge generating layer onto the surface of the intermediate layer formed on the conductive support, followed by drying.

Step (3): formation of a charge transporting layer by application of a coating liquid for charge transporting layer onto the surface of the charge generating layer formed on the intermediate layer, followed by drying.

Step (4): formation of a surface protective layer by application of a coating liquid for surface protective layer onto the surface of the charge transporting layer formed on the charge generating layer to form a coating film, followed by curing of the coating film.

These steps will now be described in detail.

(Step (1): Formation of Intermediate Layer)

The intermediate layer can be formed as follows: a binder resin for intermediate layer is dissolved in a solvent to prepare a coating liquid (hereinafter may be referred to as "coating liquid for intermediate layer"); conductive particles or metal oxide particles are optionally dispersed in the solution; the coating liquid is applied onto the conductive support to form a coating film having a specific thickness; and the coating film is dried.

The conductive particles or the metal oxide particles may be dispersed in the coating liquid for intermediate layer with any device. Examples of the device include, but are not limited to, an ultrasonic disperser, a ball mill, a sand mill, and a homomixer.

The coating liquid for intermediate layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

The solvent used for formation of the intermediate layer may be of any type that can effectively disperse the conductive particles or the metal oxide particles and can dissolve a binder resin for intermediate layer. Examples of preferred solvents include alcohols having one to four carbon atoms, such as methanol, ethanol, n-propyl alcohol, isopropyl alcohol, n-butanol, t-butanol, and sec-butanol, which exhibit high solubility for the binder resin and high coating characteristics. Any auxiliary solvent may be used in combination with the aforementioned solvent for improving storage stability or the dispersibility of particles. Examples of effective auxiliary solvents include benzyl alcohol, toluene, dichloromethane, cyclohexanone, and tetrahydrofuran.

The binder resin concentration of the coating liquid for intermediate layer is appropriately determined depending on the thickness of the intermediate layer or the rate of formation of the layer.

(Step (2): Formation of Charge Generating Layer)

The charge generating layer can be formed as follows: a binder resin for charge generating layer is dissolved in a solvent to prepare a solution; a charge generating material is dispersed in the solution to prepare a coating liquid (hereinafter may be referred to as "coating liquid for charge generating layer"); the coating liquid is applied onto the intermediate layer to form a coating film having a specific thickness; and the coating film is dried.

The charge generating material may be dispersed in the coating liquid for charge generating layer with any device. Examples of the device include, but are not limited to, an ultrasonic disperser, a ball mill, a sand mill, and a homomixer.

The coating liquid for charge generating layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

Examples of the solvent used for formation of the charge generating layer include, but are not limited to, toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine, and diethylamine.

(Step (3): Formation of Charge Transporting Layer)

The charge transporting layer can be formed as follows: a binder resin for charge transporting layer and a charge transporting material are dissolved in a solvent to prepare a coating liquid (hereinafter may be referred to as "coating liquid for charge transporting layer"); the coating liquid is applied onto the charge generating layer to form a coating film having a specific thickness; and the coating film is dried.

The coating liquid for charge transporting layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

Examples of the solvent used for formation of the charge transporting layer include, but are not limited to, toluene, xylene, dichloromethane, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

(Step (4): Formation of Surface Protective Layer)

The surface protective layer according to the present invention is formed by curing a composition containing a polymerizable compound, a charge transporting material, and at least two polymerization initiators. The polymerization initiators are the aforementioned acyl phosphine oxide and O-acyl oxime.

In specific, the surface protective layer can be formed as follows: a radically polymerizable compound, a charge transporting material, at least two polymerization initiators (including the acyl phosphine oxide and the O-acyl oxime), and optional components (metal oxide particles and another component) are added to a known solvent to prepare a coating liquid (hereinafter may be referred to as "coating liquid for surface protective layer"); the coating liquid for surface protective layer is applied onto the surface of the charge transporting layer formed in step (3) to form a coating film; the coating film is dried; and the coating film is irradiated with actinic rays (e.g., ultraviolet rays or electron beams) for curing of the radically polymerizable compound contained in the coating film.

The surface protective layer is preferably formed as follows: the radically polymerizable compound contained in the coating film is irradiated with actinic rays to generate radicals for polymerization reaction, and crosslinkages are formed through intermolecular and intramolecular crosslinking reaction for curing of the compound; i.e., the radically polymerizable compound is formed into a crosslinked cured resin.

Alternatively, the surface protective layer may be formed as follows: a component for forming the binder resin contained in the coating film is cured by heating of the coating film; i.e., the component is formed into a thermosetting resin.

In the coating liquid for surface protective layer, the amount of the metal oxide particles is preferably 5 to 60 parts by volume, more preferably 10 to 60 parts by volume, relative to 100 parts by volume of all monomers for forming the binder resin (radically polymerizable compound).

The amount of the charge transporting material is preferably 5 to 75 parts by volume, more preferably 5 to 50 parts by volume, relative to 100 parts by volume of all monomers for forming the binder resin (radically polymerizable compound).

The metal oxide particles and the charge transporting material may be dispersed in the coating liquid for surface protective layer with any device. Examples of the device include, but are not limited to, an ultrasonic disperser, a ball mill, a sand mill, and a homomixer.

The solvent used for formation of the surface protective layer may be of any type that can dissolve or disperse a monomer for the binder resin (radically polymerizable compound), the metal oxide particles, and the charge transporting material. Examples of the solvent include, but are not limited to, methanol, ethanol, n-propyl alcohol, isopropyl alcohol, n-butanol, t-butanol, sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine.

The coating liquid for surface protective layer can be applied by any known coating process. Examples of the process include dip coating, spray coating, spinner coating, bead coating, blade coating, beam coating, slide hopper coating, and circular slide hopper coating.

The coating film may be subjected to curing without drying. Preferably, the curing is performed after natural drying or thermal drying.

The drying conditions may be appropriately determined depending on the type of the solvent or the thickness of the coating film. The drying temperature is preferably room temperature (25° C.) to 180° C., particularly preferably 80 to 140° C. The drying period is preferably 1 to 200 minutes, particularly preferably 5 to 100 minutes.

The actinic rays applied to the polymerizable compound are more preferably ultraviolet rays or electron beams. Ultraviolet rays, which are easy to use, are particularly preferred.

Any ultraviolet source may be used. Examples of the ultraviolet source include low-pressure mercury lamps, middle-pressure mercury lamps, high-pressure mercury lamps, ultrahigh-pressure mercury lamps, carbon-arc lamps, metal halide lamps, xenon lamps, and flash (pulsed) xenon lamps.

The conditions of emitting actinic rays may vary depending on the type of the lamp. The dose of actinic rays is usually 5 to 500 mJ/cm$^2$, preferably 5 to 100 mJ/cm$^2$.

The power of the lamp is preferably 0.1 to 5 kW, particularly preferably 0.5 to 3 kW.

Any electron beam emitting device (electron beam source) may be used. In general, a curtain beam-type electron beam emitting device, which is relatively inexpensive and outputs high power, is effectively used as an electron beam accelerator.

The accelerating voltage during emission of electron beams is preferably 100 to 300 kV.

The absorbed dose is preferably 0.5 to 10 Mrad.

The emission period for achieving a necessary dose of actinic rays is preferably 0.1 seconds to 10 minutes, more preferably 0.1 seconds to 5 minutes, from the viewpoint of operational efficiency.

In the step of forming the surface protective layer, the coating film may be dried before, during, or after emission of actinic rays. The timing of drying may be appropriately determined in combination with the actinic ray emission conditions.

<<Image-Forming Apparatus>>

The apparatus of forming an electrophotographic image of the present invention includes the photoreceptor of the present invention. The image-forming apparatus includes a charging unit to charge the surface of the photoreceptor, an exposing unit to form an electrostatic latent image on the surface of the photoreceptor, a developing unit to develop the electrostatic latent image with a toner into a toner image, and a transferring unit to transfer the toner image onto a transfer medium. The image-forming apparatus may further include a fixing unit to fix the toner image transferred onto the transfer medium, and a cleaning unit to remove the toner remaining on the photoreceptor.

Figure 2:
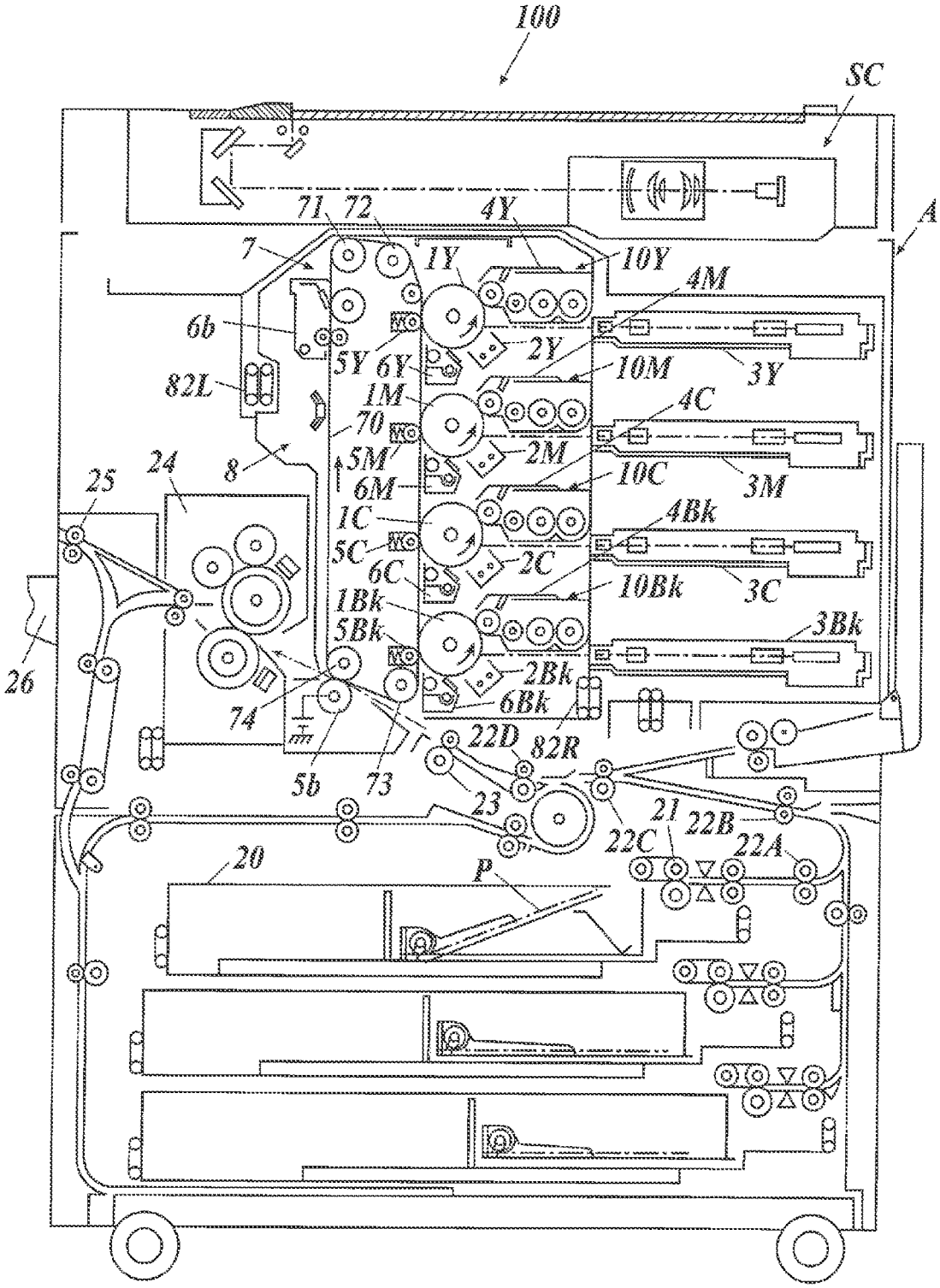
FIG. 2 is a schematic illustration of an exemplary configuration of an image-forming apparatus including the electrophotographic photoreceptor of the present invention.

FIG. 2 is a cross-sectional view of the configuration of an image-forming apparatus including the electrophotographic photoreceptor of the present invention.

The image-forming apparatus 100, which is called a tandem color image-forming apparatus, includes four image-forming units 10Y, 10M, 10C, and 10Bk, an endless-belt intermediate transferring unit 7, a sheet feeding unit 21, and a fixing unit 24. A document scanner SC is disposed above a body A of the image-forming apparatus 100.

The image-forming unit 10Y for forming a yellow image includes a charging unit 2Y, an exposing unit 3Y, a developing unit 4Y, a first transferring roller 5Y (first transferring unit), and a cleaning unit 6Y, which are disposed around a drum photoreceptor 1Y.

The image-forming unit 10M for forming a magenta image includes a drum photoreceptor 1M, a charging unit 2M, an exposing unit 3M, a developing unit 4M, a first transferring roller 5M (first transferring unit), and a cleaning unit 6M.

The image-forming unit 10C for forming a cyan image includes a drum photoreceptor 1C, a charging unit 2C, an exposing unit 3C, a developing unit 4C, a first transferring roller 5C (first transferring unit), and a cleaning unit 6C.

The image-forming unit 10Bk for forming a black image includes a drum photoreceptor 1Bk, a charging unit 2Bk, an exposing unit 3Bk, a developing unit 4Bk, a first transferring roller 5Bk (first transferring unit), and a cleaning unit 6Bk.

The image-forming apparatus 100 includes the electrophotographic photoreceptor of the present invention serving as at least one of the photoreceptors 1Y, 1M, 1C, and 1Bk.

The four image-forming units 10Y, 10M, 10C, and 10Bk respectively include the photoreceptors 1Y, 1M, 1C, and 1Bk at the center, the charging units 2Y, 2M, 2C, and 2Bk, the exposing units 3Y, 3M, 3C, and 3Bk, the rotary developing units 4Y, 4M, 4C, and 4Bk, and the cleaning units 6Y, 6M, 6C, and 6Bk for cleaning the photoreceptors 1Y, 1M, 1C, and 1Bk.

The image-forming units 10Y, 10M, 10C, and 10Bk have the same configuration except for the colors of toner images formed on the photoreceptors 1Y, 1M, 1C, and 1Bk. Thus, the following description focuses on the image-forming unit 10Y.

The image-forming unit 10Y includes the charging unit 2Y, the exposing unit 3Y, the developing unit 4Y, and the cleaning unit 6Y, which are disposed around the photoreceptor 1Y (image retainer). The image-forming unit 10Y forms a yellow (Y) toner image on the photoreceptor 1Y. In the present embodiment, at least the photoreceptor 1Y, the charging unit 2Y, the developing unit 4Y, and the cleaning unit 6Y are integrated in the image-forming unit 10Y.

The charging unit 2Y applies a uniform potential to the photoreceptor 1Y. In the present invention, the charging unit is of, for example, a contact or contactless roller charging type.

The exposing unit 3Y exposes the photoreceptor 1Y provided with the uniform potential by the charging unit 2Y in response to image signals (yellow) to form an electrostatic latent image corresponding to the yellow image. The exposing unit 3Y includes light-emitting devices (LEDs) arrayed in the axial direction of the photoreceptor 1Y and an imaging element, or includes a laser optical system.

The developing unit 4Y is composed of a developing sleeve that includes, for example, a built-in magnet and rotates while retaining a developer, and a voltage-applying device that applies a DC and/or AC bias voltage between the developing sleeve and the photoreceptor.

The fixing unit 24 is of, for example, a heat roller fixing type that is composed of a heating roller including a heat source therein and a pressurizing roller disposed in a state being pressed to the heating roller so as to form a fixing nip portion.

The cleaning unit 6Y is composed of a cleaning blade and a brush roller disposed upstream of the cleaning blade.

The aforementioned components, including the photoreceptor, the developing unit, and the cleaning unit, may be integrated into a processing cartridge (image-forming unit) that is detachably provided on the body of the image-forming apparatus 100. Alternatively, the photoreceptor and at least one of the charging unit, the exposing unit, the developing unit, the transferring unit, and the cleaning unit may be integrally supported to form a single processing cartridge (image-forming unit) that is detachably provided on the apparatus body with a guiding unit, such as a rail in the apparatus body.

The endless-belt intermediate transferring unit 7 includes an endless intermediate transferring belt 70 (a semiconductive endless belt as a second image retainer) wound around and rotatably supported by multiple rollers.

The color images formed by the image-forming units 10Y, 10M, 10C, and 10Bk are sequentially transferred onto the rotating intermediate transferring belt 70 with the respective first transferring rollers 5Y, 5M, 5C, and 5Bk (first transferring units), to form a synthesized color image. A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* (second transferring unit) via multiple intermediate rollers 22A, 22B, 22C, and 22D and register rollers 23. The color image on the intermediate transferring belt 70 is transferred at once onto the transfer medium P in a second transferring operation. The color image transferred on the transfer medium P is fixed by the fixing unit 24. The transfer medium P is then pinched between discharging rollers 25 and is conveyed to a sheet receiving tray 26 provided outside of the apparatus. The image retainers for retaining a toner image transferred from the photoreceptor, such as the intermediate transferring belt and the transfer medium, are collectively called transferring media.

After the transfer of the color image onto the transfer medium P with the second transferring roller 5*b* (second transferring unit) and the curvature separation of the transfer medium P from the turning intermediate transferring belt 70, the residual toner on the intermediate transferring belt 70 is removed by the cleaning unit 6*b*.

The first transferring roller 5Bk abuts the photoreceptor 1Bk all the time during the image formation. The first transferring rollers 5Y, 5M, and 5C abut the respective photoreceptors 1Y, 1M, and 1C only during the formation of a color image.

The second transferring roller 5*b* abuts the intermediate transferring belt 70 only during passage of the transfer medium P therebetween for the second transferring operation.

A housing 8 can be drawn along supporting rails 82L and 82R from the apparatus body A.

The housing 8 accommodates the image-forming units 10Y, 10M, 10C, and 10Bk, and the endless-belt intermediate transferring unit 7.

The image-forming units 10Y, 10M, 10C, and 10Bk are aligned in the vertical direction. The endless-belt intermediate transferring unit 7 is disposed on the left of the photoreceptors 1Y, 1M, 1C, and 1Bk in FIG. 2. The endless-belt intermediate transferring unit 7 includes the intermediate transferring belt 70 rotatably wound around rollers 71, 72, 73, and 74, the first transferring rollers 5Y, 5M, 5C, and 5Bk, and the cleaning unit 6*b*.

Although the image-forming apparatus 100 illustrated in FIG. 2 is a color laser printer, the photoreceptor of the present invention can also be applied to monochrome laser printers and copiers. The exposure light source may be a light source other than a laser, such as an LED light source.

Any toner may be used in the aforementioned image-forming apparatus. The toner used in the apparatus preferably has a shape factor SF of less than 140 relative to the shape factor SF of a spherical particle (taken as 100). A toner having a shape factor SF of less than 140 exhibits excellent transferring characteristics, leading to an improvement in the quality of a formed image. The particles of the toner preferably have a volume average particle size of 2 to 8 μm from the viewpoint of an improvement in image quality.

The toner particles generally contain a binder resin and a colorant and optionally contain a release agent. Each of the binder resin, the colorant, and the release agent may be of any type that is used in traditional toners.

The toner particles may be produced by any process. Examples of the process include a typical pulverization process, a wet melting-conglobation process in dispersion media, and a known polymerization process (e.g., suspension polymerization, dispersion polymerization, or emulsion polymerization coagulation).

The toner particles may contain an appropriate amount of an external additive, such as inorganic microparticles (e.g., silica or titania microparticles) having an average particle size of about 10 to 300 nm, or a polishing agent having a particle size of about 0.2 to 3 μm. The toner particles may be mixed with a carrier composed of, for example, ferrite beads having an average diameter of 25 to 45 μm into a two-component developer.

EXAMPLES

The present invention will now be described in detail by way of Examples, which should not be construed to limit the present invention.

Electrophotographic photoreceptors 1 to 19 were produced as described below.

[Production of Electrophotographic Photoreceptor 1]

A conductive support was prepared through milling of the surface of a cylindrical aluminum support having a diameter of 60 mm.

<Intermediate Layer>

A dispersion having the following composition was 1.5-fold diluted with the same solvent mixture as described below and allowed to stand still overnight, followed by filtration (using RIGIMESH 5 μm filter, manufactured by Nihon Pall Ltd.), to prepare a coating liquid for intermediate layer.

| | |
|---|---|
| Binder: Polyamide resin CM8000 (manufactured by Toray Industries Inc.) | 100 parts by mass |
| Metal oxide particles: Titanium oxide SMT500SAS (manufactured by TAYCA Corporation) | 120 parts by mass |
| Metal oxide particles: Titanium oxide SMT150MK (manufactured by TAYCA Corporation) | 155 parts by mass |
| Solvent: ethanol/n-PrOH/THF (proportions by volume: 60:20:20) | 1,290 parts by mass |

The dispersion was prepared through mixing of these materials with a sand mill (disperser) for five hours by a batch process.

The coating liquid was applied onto the conductive support by dip coating, and the resultant coating film was dried to form an intermediate layer having a thickness of 2 μm.

<Charge Generating Layer>

| | |
|---|---|
| Charge generating material: titanylphthalocyanine pigment (titanylphthalocyanine pigment having at least a maximum diffraction peak at 27.3° as measured by Cu-Kα X-ray diffractometry) | 20 parts by mass |
| Binder: poly(vinyl butyral) resin (#6000-C: manufactured by DENKA Co. Ltd.) | 10 parts by mass |
| Solvent: t-Butyl acetate | 700 parts by mass |
| 4-Methoxy-4-methyl-2-pentanone | 300 parts by mass |

A coating liquid for charge generating layer was prepared through mixing and dispersion of these materials with a sand mill for 10 hours. The coating liquid was applied onto the intermediate layer through dip coating, and the resultant coating film was dried to form a charge generating layer having a thickness of 0.3 μm.

<Charge Transporting Layer>

| | |
|---|---|
| Charge transporting material: 4,4'-dimethyl-4''-(β-phenylstyryl)triphenylamine | 225 parts by mass |
| Binder resin: polycarbonate (Z300: manufactured by Mitsubishi Gas Chemical Company, Inc.) | 300 parts by mass |
| Antioxidant: IRGANOX 1010 (manufactured by BASF Japan Ltd.) | 6 parts by mass |
| Solvent: tetrahydrofuran | 1,600 parts by mass |
| Toluene | 400 parts by mass |
| Leveling agent: silicone oil (KF-54: manufactured by Shin-Etsu Chemical Co., Ltd.) | 1 part by mass |

A coating liquid for charge transporting layer was prepared through mixing and dissolution of these materials. The coating liquid was applied onto the charge generating layer through dip coating, and the resultant coating film was dried to form a charge transporting layer having a thickness of 20 μm.

<Surface Protective Layer>

Silica particles (100 parts by mass) and the exemplary compound (S-15) (30 parts by mass) were mixed with a solvent mixture of toluene/isopropyl alcohol (=1/1 by mass) (300 parts by mass). The mixture was placed in a sand mill together with zirconia beads and agitated at about 40° C. and 1,500 rpm, to treat the particle surfaces with the surface modifier. The resultant mixture was removed from the sand mill and then placed in a HENSCHEL mixer, and the mixture was agitated at 1,500 rpm for 15 minutes and then dried at 120° C. for three hours, to complete the surface treatment of the silica particles with the surface modifier. The surface-treated silica particles were thereby prepared. The surfaces of the silica particles were coated with compound S-15 (surface modifier) through the aforementioned surface treatment.

| | |
|---|---|
| Silica particles (number average primary particle size of 20 nm, manufactured by Nippon Aerosil Co., Ltd.) | 54 parts by mass |
| Binder resin: radically polymerizable compound "exemplary compound M1" | 100 parts by mass |
| Charge transporting material (CTM-1) | 43 parts by mass |
| Polymerization initiator A (acyl phosphine oxide): IRGACURE 819 (manufactured by BASF Japan Ltd.) | 1.95 parts by mass |
| Polymerization initiator B (O-acyl oxime): IRGACURE OXE01 ("exemplary compound B-1") (manufactured by BASF Japan Ltd.) | 7.86 parts by mass |
| Solvent: 2-butanol | 160 parts by mass |
| 2-Methyltetrahydrofuran | 160 parts by mass |

These materials were thoroughly mixed under agitation to prepare a coating liquid for surface protective layer b sufficient dissolution and dispersion. The coating liquid was applied onto the charge transporting layer with a circular slide hopper coating machine, to form a coating film. The coating film was irradiated with ultraviolet rays from a xenon lamp for one minute. The coating film was then dried at 80° C. for 70 minutes, to form a surface protective layer having a thickness of 3.0 μm. Electrophotographic photoreceptor 1 was thereby produced.

[Production of Electrophotographic Photoreceptors 2 to 6]

Electrophotographic photoreceptors 2 to 6 were produced as in electrophotographic photoreceptor 1 except that the ratio of the amount of the polymerization initiator (A) (acyl phosphine oxide) to that of the polymerization initiator (B) (O-acyl oxime) (A:B) was varied as illustrated in Table 1.

[Production of Electrophotographic Photoreceptors 7 to 11]

Electrophotographic photoreceptors 7 to 11 were produced as in electrophotographic photoreceptor 1 except that the type of the charge transporting material was varied as illustrated in Table 1.

[Production of Electrophotographic Photoreceptors 12 to 14]

Electrophotographic photoreceptors 12 to 14 were produced as in electrophotographic photoreceptor 1 except that the type of the polymerization initiator (B) (O-acyl oxime) was varied as illustrated in Table 1.

The polymerization initiators used (illustrated in Table 1) are as follows:

IRGACURE OXE02 (manufactured by BASF Japan Ltd.)

PBG-305 and PBG-329 (manufactured by Changzhou Tronly New Electronic Materials Co., Ltd.)

PBG-305 and PBG-329 have a sulfide structure.

[Production of Electrophotographic Photoreceptors 15 and 16]

Electrophotographic photoreceptors 15 and 16 were produced as in electrophotographic photoreceptor 1 except that the type of the particulate metal oxide was varied as illustrated in Table 1.

The particulate metal oxides used (illustrated in Table 1) were as follows:

Particulate tin oxide: number average primary particle size of 20 nm (manufactured by CIK Nanotek Corporation)

Particulate alumina: number average primary particle size of 30 nm (manufactured by CIK Nanotek Corporation)

[Production of Electrophotographic Photoreceptors 17 and 18]

Electrophotographic photoreceptors 17 and 18 were produced as in electrophotographic photoreceptor 1 except that only one polymerization initiator was used as illustrated in Table 1.

[Production of Electrophotographic Photoreceptor 19]

Electrophotographic photoreceptor 19 was produced as in electrophotographic photoreceptor 1 except that the charge transporting material was not added.

[Evaluation]

<Evaluation of Electrophotographic Photoreceptor>

The above-produced electrophotographic photoreceptors 1 to 19 were evaluated as described below. The results of evaluation are illustrated in Table 1.

A commercial printer "BIZHUB PRESS C1070" (manufactured by KONICA MINOLTA, INC.), which has basically the same configuration as that of the apparatus illustrated in FIG. 2, was used as a machine for evaluation. Each of the electrophotographic photoreceptors was mounted in the machine for evaluation.

A durability test was performed involving continuous printing of a character image (image area percentage: 6%) on both sides of transversely fed size-A4 300,000 sheets in an environment of 23° C. and 50% RH. Residual image and wear resistance (α value) were evaluated during or after the durability test.

<<Residual Image>>

After the durability test, a solid black and white image was continuously printed on 10 sheets, and a uniform halftone image was then printed on another sheet, to determine whether or not the solid black and white image remained on the halftone image for evaluation of residual image based on the following criteria:

A: No residual image (excellent)

B: Residual image only at an edge portion (practically acceptable)

C: Slight residual image over the entire sheet (practically acceptable)

D: Noticeable residual image (impractical)

<<Wear Resistance>>

For evaluation of wear resistance, the thickness of the photosensitive layer was measured before and after the durability test to calculate a reduction in thickness caused by wear.

The thickness of the photosensitive layer corresponds to the average of the thicknesses of randomly selected 10 layer portions of uniform thickness (excluding portions of irregular thickness (i.e., front and rear end portions of coating) on the basis a layer thickness profile).

The thickness is measured with an eddy-current thickness meter EDDY560C (manufactured by HELMUT FISCHER GmbH CO), and the difference between the thickness of the photosensitive layer before the durability test and that after the durability test is defined as a reduction in thickness caused by wear. As used herein, the "α value" corresponds to a reduction in thickness per 100 krot (100,000 rotations). The results are illustrated in Table 1. An a value of 0.2 μm or less is an acceptable level in the present invention.

TABLE 1

| ELECTROPHOTOGRAPHIC PHOTORECEPTOR No. | CHARGE TRANSPORTING MATERIAL | ACYL PHOSPHINE OXIDE (A) | O-ACYL OXIME (B) | A:B | METAL OXIDE PARTICLE | RESIDUAL IMAGE | α VALUE [μm] | REMARKS |
|---|---|---|---|---|---|---|---|---|
| 1 | CTM-1 | Irg819 | 0XE01 | 2:8 | $SiO_2$ | C | 0.13 | PRESENT INVENTION |
| 2 | CTM-1 | Irg819 | 0XE01 | 3:7 | $SiO_2$ | B | 0.14 | PRESENT INVENTION |
| 3 | CTM-1 | Irg819 | 0XE01 | 5:5 | $SiO_2$ | A | 0.19 | PRESENT INVENTION |
| 4 | CTM-1 | Irg819 | 0XE01 | 7:3 | $SiO_2$ | A | 0.15 | PRESENT INVENTION |
| 5 | CTM-1 | Irg819 | 0XE01 | 8:2 | $SiO_2$ | A | 0.18 | PRESENT INVENTION |
| 6 | CTM-1 | Irg819 | 0XE01 | 9.1 | $SiO_2$ | A | 0.20 | PRESENT INVENTION |
| 7 | CTM-2 | Irg819 | 0XE01 | 7:3 | $SiO_2$ | B | 0.16 | PRESENT INVENTION |
| 8 | CTM-3 | Irg819 | 0XE01 | 7:3 | $SiO_2$ | B | 0.17 | PRESENT INVENTION |
| 9 | CTM-4 | Irg819 | 0XE01 | 7:3 | $SiO_2$ | B | 0.16 | PRESENT INVENTION |
| 10 | CTM-5 | Irg819 | 0XE01 | 7:3 | $SiO_2$ | C | 0.15 | PRESENT INVENTION |
| 11 | CTM-6 | Irg819 | 0XE01 | 7:3 | $SiO_2$ | C | 0.14 | PRESENT INVENTION |
| 12 | CTM-1 | Irg819 | 0XE02 | 7:3 | $SiO_2$ | A | 0.20 | PRESENT INVENTION |
| 13 | CTM-1 | Irg819 | PBG-305 | 7:3 | $SiO_2$ | A | 0.18 | PRESENT INVENTION |
| 14 | CTM-1 | Irg819 | PBG-329 | 7:3 | $SiO_2$ | A | 0.19 | PRESENT INVENTION |
| 15 | CTM-1 | Irg819 | 0XE01 | 7:3 | $Al_2O_3$ | B | 0.16 | PRESENT INVENTION |

TABLE 1-continued

| ELECTROPHOTOGRAPHIC PHOTORECEPTOR No. | CHARGE TRANSPORTING MATERIAL | ACYL PHOSPHINE OXIDE (A) | O-ACYL OXIME (B) | A:B | METAL OXIDE PARTICLE | RESIDUAL IMAGE | α VALUE [μm] | REMARKS |
|---|---|---|---|---|---|---|---|---|
| 16 | CTM-1 | Irg819 | 0XE01 | 7:3 | $SnO_2$ | B | 0.18 | PRESENT INVENTION |
| 17 | CTM-1 | Irg819 | — | — | $SiO_2$ | B | 3.30 | COMPARATIVE EXAMPLE |
| 18 | CTM-1 | — | 0XE01 | — | $SiO_2$ | D | 0.14 | COMPARATIVE EXAMPLE |
| 19 | — | Irg819 | 0XE01 | 7:3 | $SiO_2$ | D | 0.05 | COMPARATIVE EXAMPLE |

The results illustrated in Table 1 demonstrate that electrophotographic photoreceptors 1 to 16 exhibit a reduction in residual image formation and superior wear resistance as compared with electrophotographic photoreceptors 17 to 19.

The present invention can provide an electrophotographic photoreceptor that can achieve the compatibility between a reduction in residual image formation and high wear resistance while maintaining durability, a method of producing the photoreceptor, and an apparatus of forming an electrophotographic image. According to the present invention, the formation of a surface protective layer using an acyl phosphine oxide and an O-acyl oxime as polymerization initiators allows curing reaction to proceed efficiently even in the presence of a charge transporting material having high hole transporting ability. Thus, the resultant surface protective layer exhibits high strength. Since a charge transporting material having high hole transporting ability can be incorporated into the surface protective layer, the surface protective layer exhibits a sufficient reduction in residual image formation in addition to high strength.

The mechanisms that establish the advantageous effects of the present invention are not clarified but are inferred as described below.

The surface protective layer containing the charge transporting material contains an acyl phosphine oxide polymerization initiator having high internal curability in combination with an O-acyl oxime polymerization initiator having high reactivity. Thus, the curing reaction proceeds efficiently even if the effects of the polymerization initiators are reduced through absorption of light by the charge transporting material within the optical absorption wavelength range of the polymerization initiators. Accordingly, the surface protective layer exhibits improved strength and high wear resistance.

It is concerned that by-products derived from the O-acyl oxime polymerization initiator could trap holes and impair electrical properties, resulting in adverse effects on a reduction in residual image formation. The by-products, however, can be inhibited by the acyl phosphine oxide, and thus electrical properties are prevented from being impaired, leading to a reduction in residual image formation. Thus, the electrophotographic photoreceptor can achieve the compatibility between a reduction in residual image formation and high wear resistance.

What is claimed is:

1. An electrophotographic photoreceptor comprising a conductive support, a photosensitive layer, and a surface protective layer disposed in sequence, wherein the surface protective layer comprises a cured product of a composition containing a polymerizable compound, a charge transporting material, and at least two polymerization initiators, the charge transporting material exhibits a maximum absorption wavelength of 405±50 nm in an absorption spectrum, the polymerization initiators comprise an acyl phosphine oxide and an O-acyl oxime, when amounts of the acyl phosphine oxide and the O-acyl oxime are respectively expressed as A and B, a weight ratio A:B is within a range of 3:7 to 8:2, and the O-acyl oxime has a structure represented by Formula (1) or is a compound B-40:

Formula (1)

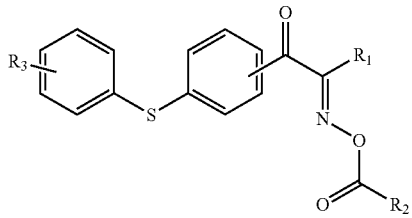

where $R_1$ and $R_2$ each represent a moiety selected from the group consisting of a hydrogen atom, an alkyl group having one to six carbon atoms and optionally having a substituent, a cycloalkyl group having three to six carbon atoms and optionally having a substituent, and an aryl group optionally having a substituent; and $R_3$ represents a moiety selected from the group consisting of a hydrogen atom, a halogen atom, a cyano group, a nitro group, a hydroxy group, an alkyl group having one to six carbon atoms and optionally having a substituent, an alkoxy group having one to six carbon atoms and optionally having a substituent, an aryl group optionally having a substituent, and a carbonyl group optionally having a substituent;

B-40 (OXE02)

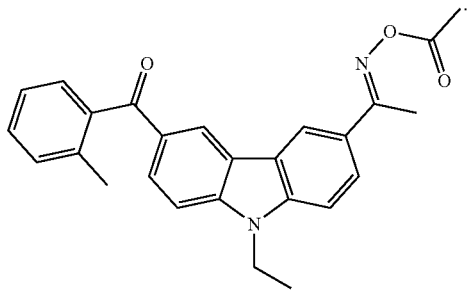

2. The electrophotographic photoreceptor according to claim 1, wherein the O-acyl oxime has the structure represented by the Formula (1).

3. The electrophotographic photoreceptor according to claim 1, wherein the surface protective layer contains metal oxide particles.

4. The electrophotographic photoreceptor according to claim 3, wherein the metal oxide particles have a reactive organic group.

5. A method of producing an electrophotographic photoreceptor comprising a conductive support, a photosensitive layer, and a surface protective layer disposed in sequence, the method comprising forming the surface protective layer by curing a composition containing a polymerizable compound, a charge transporting material, and at least two polymerization initiators, wherein the polymerization initiators comprise an acyl phosphine oxide and an O-acyl oxime, wherein, the charge transporting material exhibits a maximum absorption wavelength of 405±50 nm in an absorption spectrum, when amounts of the acyl phosphine oxide and the O-acyl oxime are respectively expressed as A and B, a weight ratio A:B is within a range of 3:7 to 8:2, and the O-acyl oxime has a structure represented by Formula (1) or is a compound B-40:

Formula (1)

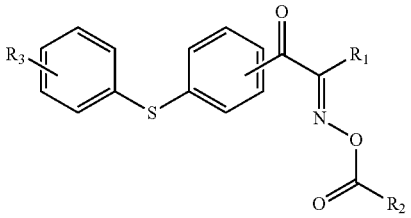

where $R_1$ and $R_2$ each represent a moiety selected from the group consisting of a hydrogen atom, an alkyl group having one to six carbon atoms and optionally having a substituent, a cycloalkyl group having three to six carbon atoms and optionally having a substituent, and an aryl group optionally having a substituent; and $R_3$ represents a moiety selected from the group consisting of a hydrogen atom, a halogen atom, a cyano group, a nitro group, a hydroxy group, an alkyl group having one to six carbon atoms and optionally having a substituent, an alkoxy group having one to six carbon atoms and optionally having a substituent, an aryl group optionally having a substituent, and a carbonyl group optionally having a substituent;

B-40 (OXE02)

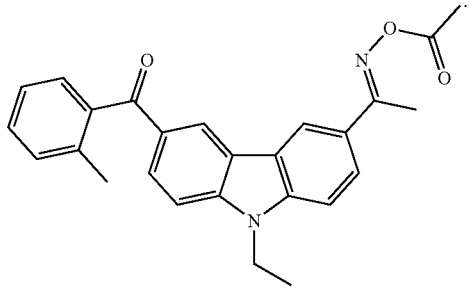

6. The method of producing an electrophotographic photoreceptor according to claim 5, wherein the O-acyl oxime has the structure represented by the Formula (1).

7. The method of producing an electrophotographic photoreceptor according to claim 5, wherein the surface protective layer contains metal oxide particles.

8. The method of producing an electrophotographic photoreceptor according to claim 7, wherein the metal oxide particles have a reactive organic group.

9. An apparatus of forming an electrophotographic image, the apparatus comprising an electrophotographic photoreceptor, a charging unit to charge the electrophotographic photoreceptor, an exposing unit, a developing unit, and a transferring unit, wherein the electrophotographic photoreceptor is the electrophotographic photoreceptor according to claim 1, the charging unit is a contact or contactless roller, the exposing unit includes a light emitting device arrayed in an axial direction of the photoreceptor and an imaging element, or includes a laser optical system, the developing unit is composed of a developing sleeve that includes a built-in magnet and rotates while retaining a developer, and a voltage-applying device that applies a voltage between the developing sleeve and the photoreceptor, and the transferring unit includes an endless intermediate transferring belt wound around and rotatably supported by multiple rollers.

* * * * *